US009290871B2

(12) United States Patent
Kato

(10) Patent No.: US 9,290,871 B2
(45) Date of Patent: Mar. 22, 2016

(54) APPARATUS AND NON-TRANSITORY COMPUTER-READABLE MEDIUM STORING COMPUTER-READABLE INSTRUCTIONS

(71) Applicant: BROTHER KOGYO KABUSHIKI KAISHA, Nagoya-shi, Aichi-ken (JP)

(72) Inventor: Aki Kato, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/638,603

(22) Filed: Mar. 4, 2015

(65) Prior Publication Data

US 2015/0267331 A1 Sep. 24, 2015

(30) Foreign Application Priority Data

Mar. 24, 2014 (JP) ..... 2014-059415

(51) Int. Cl.
*D05C 5/02* (2006.01)
*D05B 19/10* (2006.01)

(52) U.S. Cl.
CPC ..... *D05B 19/10* (2013.01)

(58) Field of Classification Search
CPC ..... D05B 19/02; D05B 19/04; D05B 19/08; D05B 19/10
USPC ..... 700/136–138
See application file for complete search history.

(56) References Cited

U.S. PATENT DOCUMENTS

| | | | | |
|---|---|---|---|---|
| 5,553,559 | A | 9/1996 | Inoue et al. | |
| 6,167,822 | B1 * | 1/2001 | Miyasako et al. | 112/102.5 |
| 2013/0112126 | A1 * | 5/2013 | Tokura | 112/102.5 |
| 2013/0112127 | A1 * | 5/2013 | Tokura | 112/102.5 |

FOREIGN PATENT DOCUMENTS

JP H06319879 A 11/1994

* cited by examiner

*Primary Examiner* — Nathan Durham
(74) *Attorney, Agent, or Firm* — Oliff PLC

(57) ABSTRACT

An apparatus includes a processor and a memory configured to store computer-readable instructions. The computer-readable instructions, when executed by the processor, cause the apparatus to perform processes of acquiring first pattern data and second pattern data, the first pattern data being data for sewing a first embroidery pattern, and the second pattern data being data for sewing each of at least one second embroidery pattern, identifying, based on the first pattern data, at least one characteristic point of a pattern shape describing the first embroidery pattern, setting positioning data for positioning and sewing the at least one second embroidery pattern at the respective identified at least one characteristic point, and generating sewing data, based on the first pattern data, the second pattern data, and the positioning data. The sewing data is data for sewing the first embroidery pattern and the at least one second embroidery pattern.

12 Claims, 25 Drawing Sheets

APPARATUS AND NON-TRANSITORY COMPUTER-READABLE MEDIUM STORING COMPUTER-READABLE INSTRUCTIONS

CROSS-REFERENCE TO RELATED APPLICATION

This application claims priority to Japanese Patent Application No. 2014-059415 filed Mar. 24, 2014, the content of which is hereby incorporated herein by reference.

BACKGROUND

The present disclosure relates to an apparatus and a non-transitory computer-readable medium that stores computer-readable instructions.

A known embroidery sewing machine stores sewing data and stitch data that indicates a reference position that is necessary for positioning a pattern such that aligning of a pattern to an already sewn pattern is to be performed efficiently and accurately in a case where a plurality of patterns are combined and sewn. In the embroidery sewing machine, the pattern that is sewn first and a stitch that indicates the reference position for that pattern are sewn on a cloth based on the sewing data and the stitch data. A user is therefore able to recognize the reference position.

SUMMARY

For example, a case may occur in which the user desires to sew a plurality of decorative patterns of comparatively small size on individual characters of a character pattern that is made up of a plurality of characters, in order to make the pattern more decorative. Hereinafter, the resulting pattern is called a decorated character pattern. Specifically, the decorated character pattern is an embroidery pattern that is made by combining a character pattern and a decorative pattern. In a case where a decorated character pattern is sewn by the embroidery sewing machine that is described above, the user need to manually align the sewing positions of the character pattern and the decorative pattern. That task means time and effort for the user.

Embodiments of the broad principles derived herein provide an apparatus that can easily generate sewing data for combining and sewing a plurality of patterns, and also provide a non-transitory computer-readable medium that stores computer-readable instructions.

Embodiments provide an apparatus including a processor and a memory. The memory is configured to store computer-readable instructions. The computer-readable instructions, when executed by the processor, cause the apparatus to perform processes of acquiring first pattern data and second pattern data, the first pattern data being data for sewing a first embroidery pattern, and the second pattern data being data for sewing each of at least one second embroidery pattern, identifying, based on the first pattern data, at least one characteristic point of a pattern shape describing the first embroidery pattern, setting positioning data for positioning and sewing the at least one second embroidery pattern at the respective identified at least one characteristic point, and generating sewing data, based on the first pattern data, the second pattern data, and the positioning data. The sewing data is data for sewing the first embroidery pattern and the at least one second embroidery pattern in a sewing order in which the at least one of second embroidery pattern is sewn after the first embroidery pattern is sewn.

Embodiments also provide a non-transitory computer-readable medium storing computer-readable instructions that, when executed by a processor of an apparatus, cause the apparatus to perform processes that include acquiring first pattern data and second pattern data, the first pattern data being data for sewing a first embroidery pattern, and the second pattern data being data for sewing each of at least one second embroidery pattern, identifying, based on the first pattern data, at least one characteristic point of a pattern shape describing the first embroidery pattern, setting positioning data for positioning and sewing the at least one second embroidery pattern at the respective identified at least one characteristic point, and generating sewing data, based on the first pattern data, the second pattern data, and the positioning data. The sewing data is data for sewing the first embroidery pattern and the at least one second embroidery pattern in a sewing order in which the at least one of second embroidery pattern is sewn after the first embroidery pattern is sewn.

BRIEF DESCRIPTION OF THE DRAWINGS

Embodiments will be described below in detail with reference to the accompanying drawings in which.

DETAILED DESCRIPTION

Figure 1:
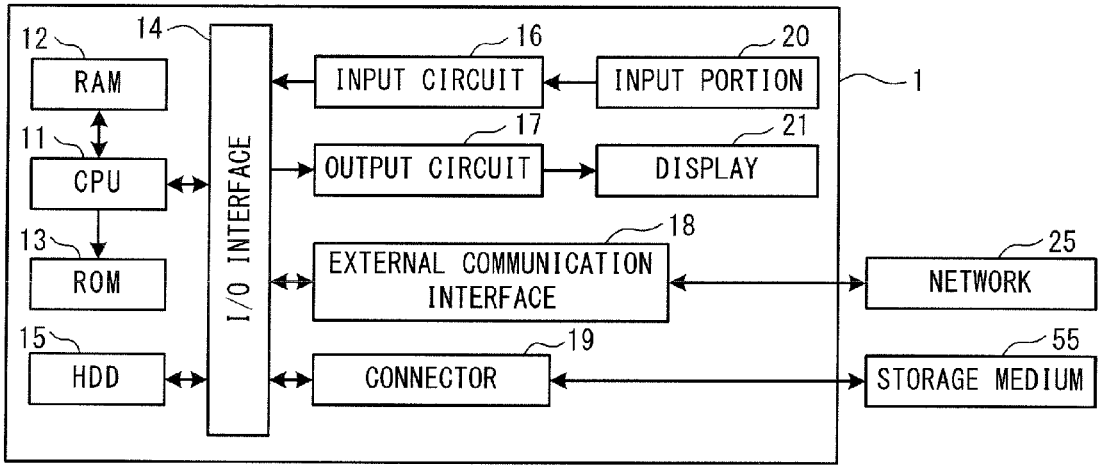
FIG. 1 is a block diagram that shows an electrical configuration of sewing data generation device.

An embodiment will be explained with reference to the drawings. The configuration of a sewing data generation device 1 will be explained with reference to FIG. 1. The sewing data generation device 1 is a device that is able to generate embroidery data for the forming, by a sewing machine 3 (refer to FIG. 3), of stitches of an embroidery pattern in a sewing workpiece (for example, a work cloth) that is held by an embroidery frame 41.

The sewing data generation device 1 may be a device that is dedicated to generating the embroidery data. The sewing data generation device 1 may be a general-purpose device such as a personal computer or the like. In the present embodiment, the general-purpose sewing data generation device 1 is used as an example. The sewing data generation device 1 includes a CPU 11, which is a controller that performs control of the sewing data generation device 1. A RAM 12, a ROM 13, and an input/output (I/O) interface 14 are connected to the CPU 11. The RAM 12 temporarily stores various types of data, such as computation results and the like that are produced by computational processing by the CPU 11. The ROM 13 stores a bios and the like.

The I/O interface 14 performs mediation of data transfers. A hard disk device (HDD) 15, an input circuit 16, an output circuit 17, an external communication interface 18, and a connector 19 are connected to the I/O interface 14.

An input portion 20, such as a keyboard or the like, is connected to the input circuit 16. A display 21, which is a display device, is connected to the output circuit 17. The external communication interface 18 is an interface that can connect to a network 25. The sewing data generation device 1 can connect to an external device through the network 25. A storage medium 55, such as a memory card or the like, can be connected to the connector 19. Through the connector 19, the sewing data generation device 1 is able to read data from the storage medium 55 and write data to the storage medium 55.

Figure 2:
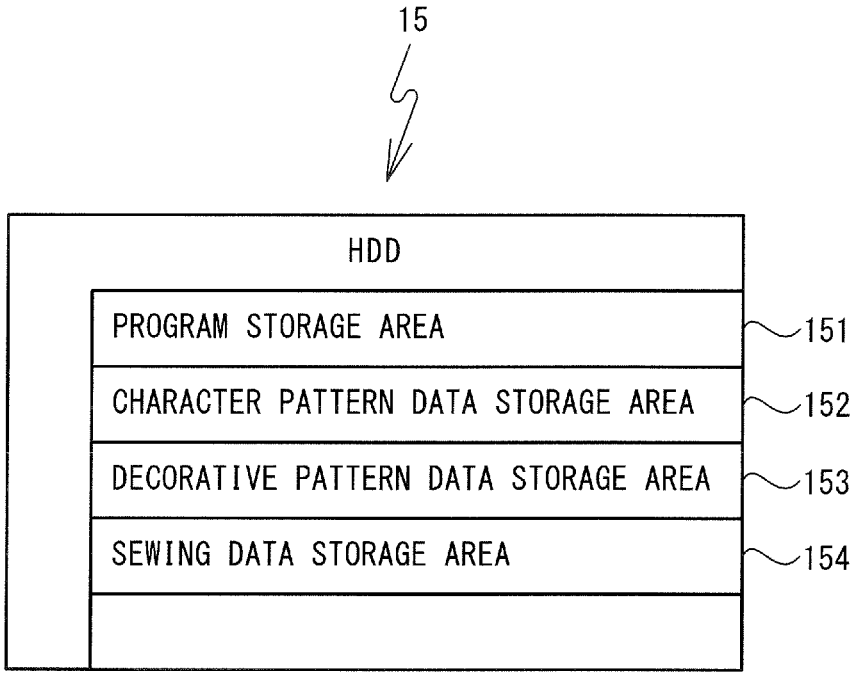
FIG. 2 is a conceptual diagram that shows various types of storage areas in a hard disk device.

Various types of storage areas in the HDD 15 will be explained with reference to FIG. 2. The HDD 15 includes various types of storage areas, including a program storage area 151, a character pattern data storage area 152, a decorative pattern data storage area 153, and a sewing data storage area 154. The program storage area 151 stores various types of programs, including a program for performing decorated character pattern creation processing (refer to FIG. 4).

Figure 5:
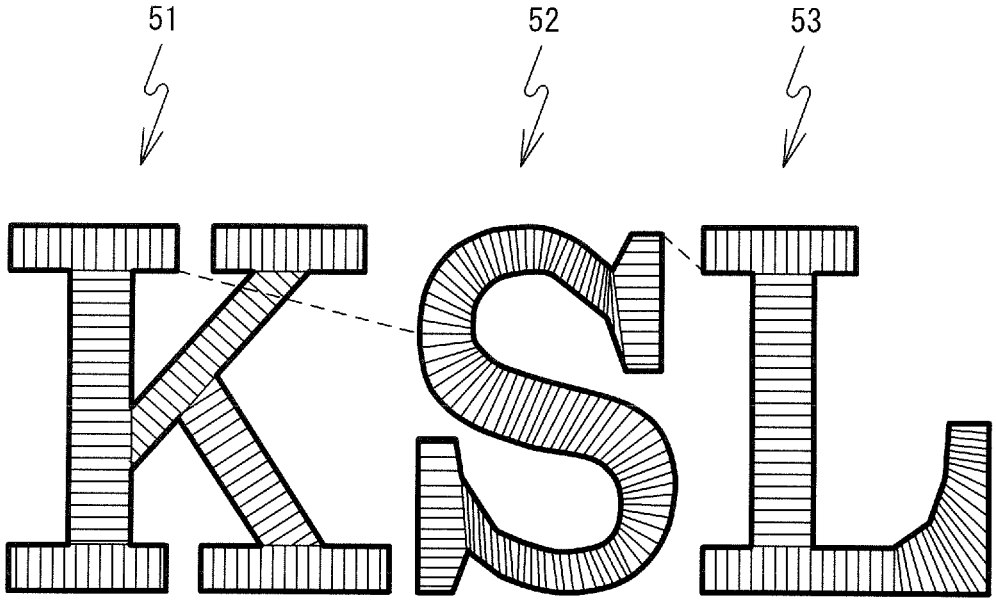
FIG. 5 is a figure that shows a character pattern.

The character pattern data storage area 152 stores character pattern data. The character pattern data include shape data for a character pattern, thread color data that indicate the color of a thread, mask data for the character pattern, and the like. The character pattern is an embroidery pattern that indicates the shape of a character, as do alphabetic character patterns 51 to 53 shown in FIG. 5, for example. The shape data are data for creating the shape of a character. The shape data include block data, single-stitch data, and the like, for example. The block data and the single-stitch data will be explained below. The mask data for a character pattern are data that indicate the smallest rectangle that can encompass the character pattern. The center point of the character pattern is defined by the coordinates of the intersection point of the diagonals of the rectangle that is indicated by the mask data. Coordinate data are data that indicate the coordinates in an XY coordinate system (refer to FIG. 3) that will be described below.

Figure 6:
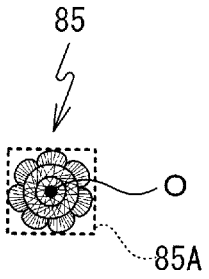
FIG. 6 is a figure that shows a decorative pattern.

The decorative pattern data storage area 153 stores decorative pattern data. The decorative pattern data include coordinate data for needle drop points of a sewing needle 44 (refer to FIG. 3) in a decorative pattern, stitch data that indicate types of and setting values for stitches in the decorative pattern, thread color data that indicate the color of a thread, mask data for the decorative pattern, and the like. The decorative patterns are embroidery patterns that are used when a decorated character pattern (refer to FIG. 25) is created by combining the decorative patterns, such as a floral decorative pattern 85 shown in FIG. 6, with the character pattern. The stitches of the decorative pattern may be satin stitches, fill stitches, and the like, for example. The needle drop point is a point where the sewing needle 44, which is disposed directly above a needle hole (not shown in the drawings), pierces the sewing workpiece when a needle bar 35 is moved downward from above the sewing workpiece. The setting values are setting values for stitch angles, thread density, and the like, for example. The mask data for a decorative pattern are data that indicate the smallest rectangle that can encompass the decorative pattern. The center point of the decorative pattern is defined by the coordinates of the intersection point of the diagonals of the rectangle that is indicated by the mask data. Coordinate data are data that indicate the coordinates in an XY coordinate system that will be described below. A user can use a pattern editing function of the sewing data generation device 1 to edit the character pattern and the decorative pattern, and can also generate sets of pattern data for forming the character pattern and the decorative pattern, respectively.

The sewing data storage area 154 stores various types of sewing data. The various types of sewing data include sewing data for sewing a decorated character pattern that is generated by the decorated character pattern creation processing (refer to FIG. 4), which will be described below. The various types of sewing data also include sewing data and the like for sewing an ordinary embroidery pattern. The sewing data are data that, in the same manner as the stitch data, indicate the coordinates of the needle drop points and the stitch order for forming the stitches of the embroidery pattern. The sewing data for the decorated character pattern will be described below.

Figure 3:
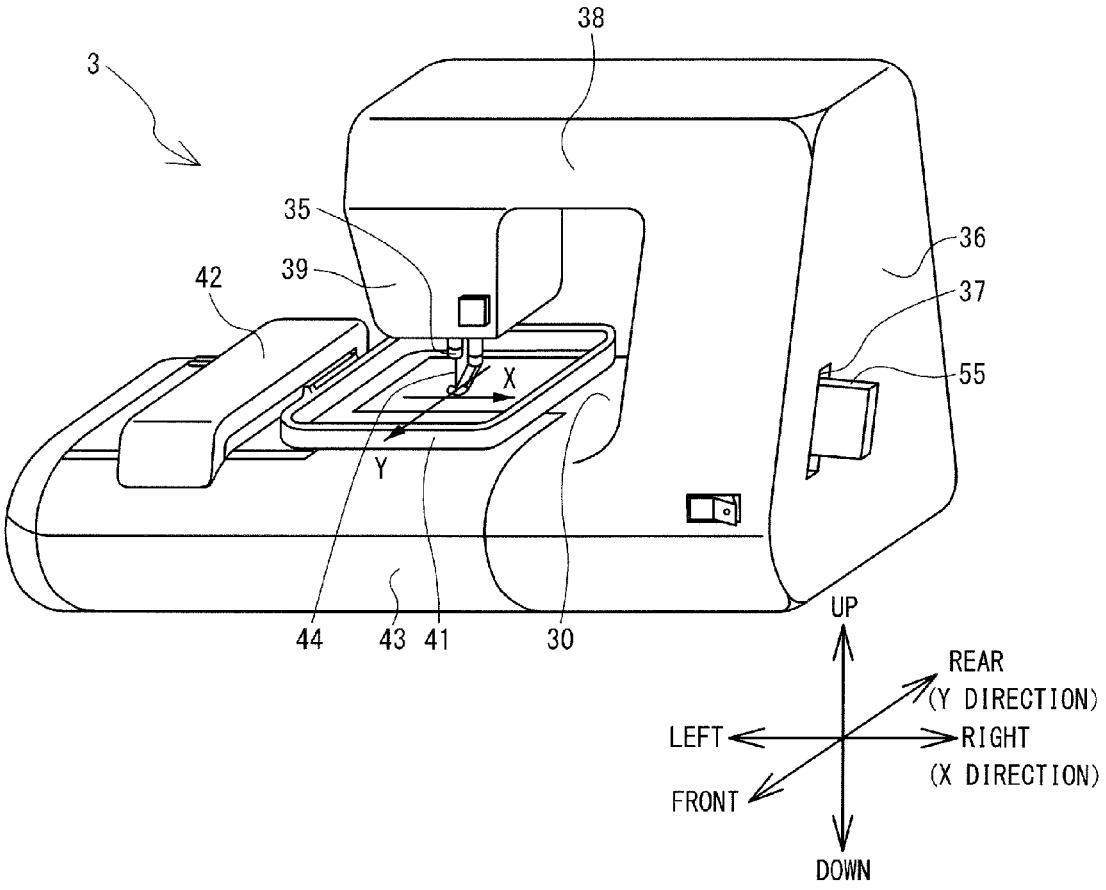
FIG. 3 is an oblique view of a sewing machine.

The sewing machine 3 will be explained briefly with reference to FIG. 3. The sewing machine 3 is capable of sewing an embroidery pattern based on the sewing data. The sewing machine 3 includes a bed 30, a pillar 36, an arm 38, and a head 39. The bed 30 is the base of the sewing machine 3 and is long in the left-right direction. The pillar 36 extends upward from the right end portion of the bed 30. The arm 38 extends to the left from the upper end of the pillar 36 such that the arm 38 is positioned opposite the bed 30. The head 39 is a portion that is joined to the left end of the arm 38.

When performing embroidery sewing, the user of the sewing machine 3 may mount an embroidery frame 41 that holds a sewing workpiece onto a carriage 42 that is disposed on the bed 30. The embroidery frame 41 is moved to the coordinates of a needle drop point by a Y axis moving mechanism (not shown in the drawings) and an X axis moving mechanism (not shown in the drawings). The Y axis moving mechanism is contained in the carriage 42. The X axis moving mechanism is contained in a body case 43. The coordinates of the needle drop point are indicated by an XY coordinate system that is specific to the sewing machine 3. In the present embodiment, the X direction is the left-right direction of the sewing machine 3. The positive X direction is the direction from left to right. The negative X direction is the direction from right to left. The Y direction is front-rear direction of the sewing machine 3. The positive Y direction is the direction from the rear to the front. The negative Y direction is the direction from the front to the rear. In conjunction with the moving of the embroidery frame 41, a shuttle mechanism (not shown in the drawings) and the needle bar 35 on which the sewing needle 44 is attached are driven. The embroidery pattern is thus formed on the sewing workpiece. The Y axis moving mechanism, the X axis moving mechanism, the needle bar 35, and the like are controlled based on the sewing data by a CPU (not shown in the drawings) that is built into the sewing machine 3.

A connector 37 is provided on a side face of the pillar 36 of the sewing machine 3. The storage medium 55 may be mounted in and removed from the connector 37. For example, the sewing data generated by the sewing data generation device 1 are stored in the storage medium 55 through the connector 19, as shown in FIG. 1. Then the storage medium 55 may be mounted in the connector 37 of the sewing machine 3. The stored sewing data may be read and stored in the sewing machine 3. Based on the stored sewing data, the CPU of the sewing machine 3 may control the operation of sewing the embroidery pattern. The sewing machine 3 is thus able to sew the embroidery pattern based on the sewing data generated by the sewing data generation device 1.

The decorated character pattern creation processing that the CPU 11 performs will be explained with reference to FIGS. 4 to 25. The sewing data generation device 1 is capable of performing both the decorated character pattern creation processing and ordinary processing. The decorated character pattern creation processing is processing that generates the sewing data for the decorated character pattern. The ordinary processing is processing that generates the sewing data for an ordinary embroidery pattern. Using the input portion 20, the user can perform operations to select and start various types of processing. When the CPU 11 detects the operations to select and start the decorated character pattern creation processing, the CPU 11 reads into the RAM 12 the program for performing the decorated character pattern creation processing stored in the program storage area 151 of the HDD 15, then performs the processing below by executing the instructions contained in the program.

Figure 4:
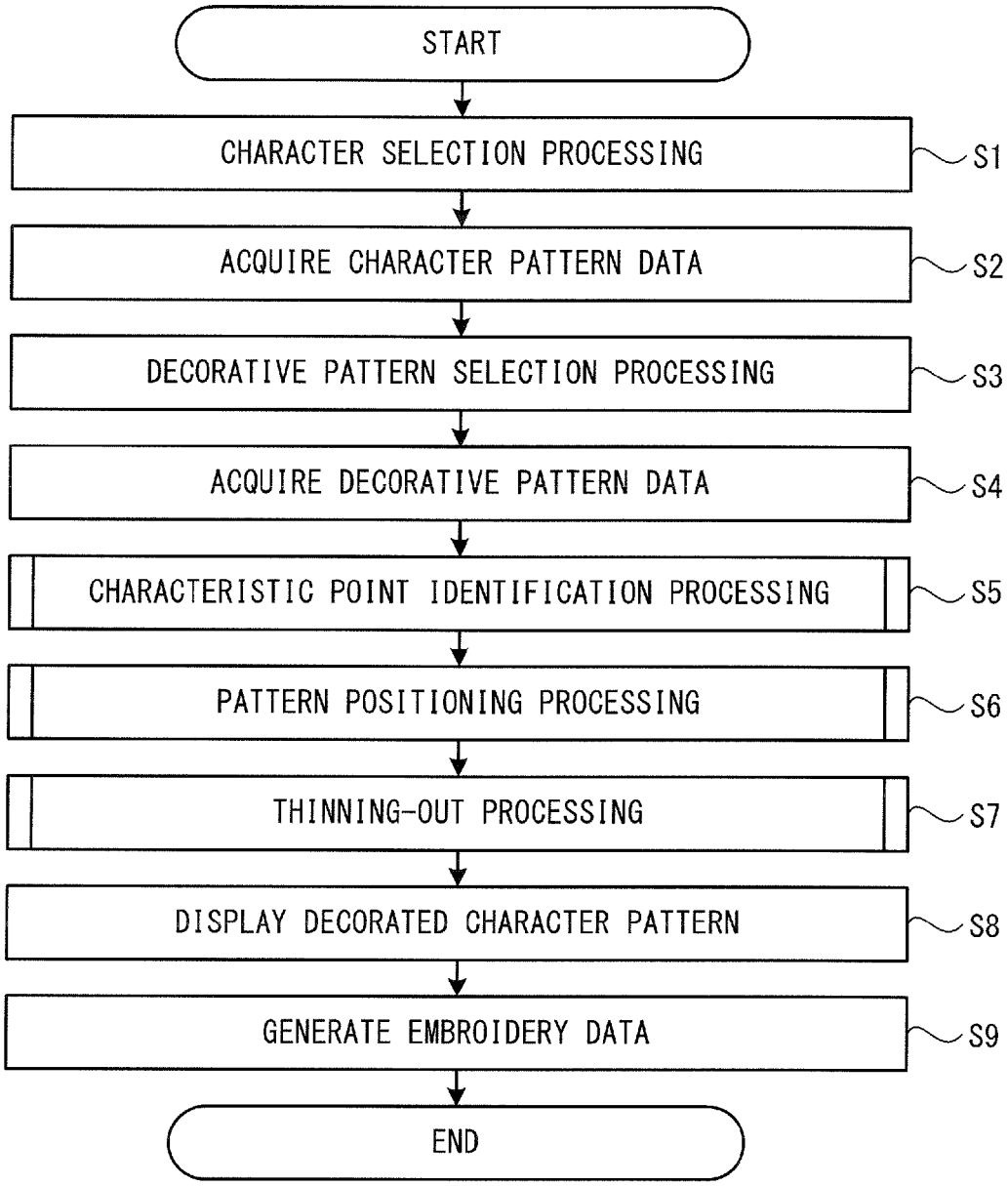
FIG. 4 is a flowchart of decorated character pattern creation processing.

As shown in FIG. 4, first, the CPU 11 performs character selection processing (Step S1). The character selection processing is processing that allows the user to select a character pattern. The CPU 11 displays a character pattern selection screen, for example, on the display 21, then waits until the CPU 11 detects that a character pattern is selected by the user. A single character may be selected, and a plurality of characters may be selected. For each of the character patterns, there are a plurality of variations, in which the shape, the style, the color, and the like of the character are different. In the present embodiment, it is assumed that the user selects the three character patterns 51 to 53 shown in FIG. 5. The character pattern 51 is the alphabetic character "K", the character pattern 52 is the alphabetic character "S", and the character pattern 53 is the alphabetic character "L".

When the CPU 11 detects that the character patterns 51 to 53 is selected, the CPU 11 acquires from the character pattern data storage area 152 of the HDD 15 the character pattern data sets that correspond to the selected character patterns 51 to 53 (Step S2) and stores the character pattern data sets in the RAM 12. Each one of the character patterns 51 to 53 is configured from block data that will be described below.

Figure 7:
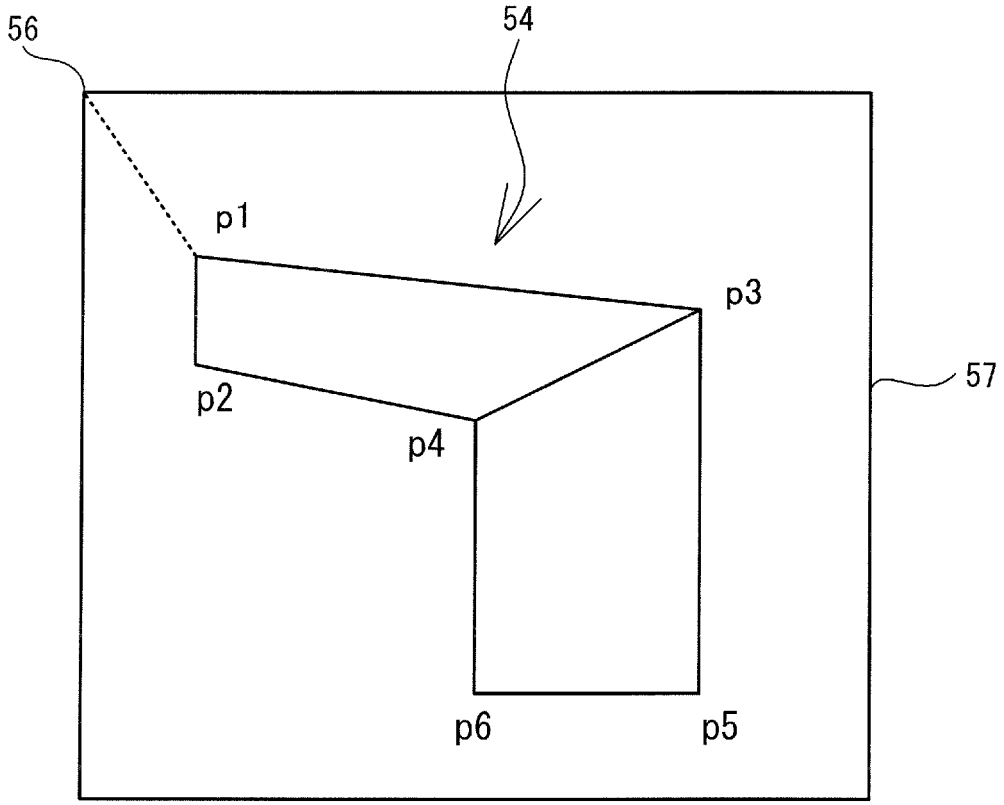
FIG. 7 is a conceptual diagram of a portion of block data that configure the character pattern.

The block data will be explained with reference to FIGS. 7 and 8. The block data are coordinate data for the individual vertices of a four-sided block that is defined by four points. FIG. 7 shows two blocks that configure a portion of a character pattern 54. One of the blocks is configured from points p1, p2, p3, and p4, and another of the blocks is configured from points p3, p4, p5, and p6. The points p1 and p4 are positioned at opposite ends of a diagonal of the first block. The points p2 and p3 are positioned at opposite ends of another diagonal of the first block. The points p3 and p6 are positioned at opposite ends of a diagonal of the second block. The points p4 and p5 are positioned at opposite ends of another diagonal of the second block. A rectangle that is indicated by mask data 57 for the character pattern 54 encompasses the two blocks. The point p1 is the vertex that is the closest to a start point 56 of the mask data 57. The start point 56 is a point that indicates the position where the sewing by the sewing machine 3 is to be started. For the block data for each of the four-sided blocks, the CPU 11 computes needle drop points on two opposing sides of the four-sided block such that a predetermined thread density can be achieved. The thread density is information about the number of stitches that is to be disposed within one block, and the thread density is included in the character pattern data.

Figure 8:
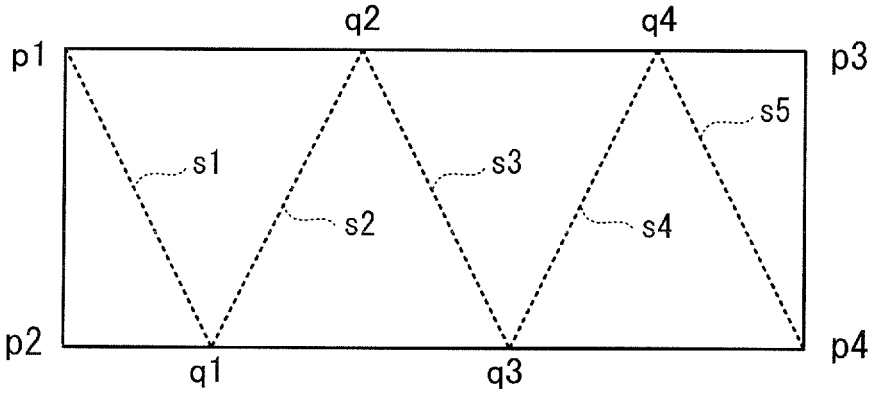
FIG. 8 is a conceptual diagram of block data with a thread density of 5.

FIG. 8 shows an example of block data for which the thread density is 5. Needle drop points q1 and q3 are set on a side p2-p4, which is one side of one four-sided block. Needle drop points q2 and q4 are set on a side p1-p3, which is another side of the one four-sided block. Five stitches s1 to s5 are disposed within the block. The stitch s1 data indicate a stitch that links the starting point p1 and the ending point q1. The stitch s2 data indicate a stitch that links the starting point q1 and the ending point q2. The stitch s3 data indicate a stitch that links the starting point q2 and the ending point q3. The stitch s4 data indicate a stitch that links the starting point q3 and the ending point q4. The stitch s5 data indicate a stitch that links the starting point q4 and the ending point p4.

Next, as shown in FIG. 4, the CPU 11 performs decorative pattern selection processing (Step S3). The decorative pattern selection processing is processing that allows the user to select a decorative pattern that is to be disposed in combination with the character pattern. In the same manner as in the character selection processing, the CPU 11 displays a decorative pattern selection screen, for example, on the display 21. The CPU 11 then waits until the CPU 11 detects that a decorative pattern is selected by the user. In the present embodiment, it is assumed that the user selects the floral decorative pattern 85 shown in FIG. 6. When the CPU 11 detects that the floral decorative pattern 85 is selected, the CPU 11 acquires the decorative pattern data for the selected floral decorative pattern 85 from the decorative pattern data storage area 153 of the HDD 15 (Step S4) and stores the decorative pattern data in the RAM 12. The decorative pattern data for the decorative pattern 85 include mask data 85A (refer to FIG. 6) and the like. A center point O of the decorative pattern 85 is set at the intersection point of diagonals of the mask data 85A.

Next, as shown in FIG. 4, the CPU 11 performs characteristic point identification processing (Step S5). The characteristic point identification processing is processing that identifies characteristic points of the character pattern. The characteristic points of the character pattern are points that characterize the shape of the character pattern. The characteristic points of the character pattern include endpoints and a vertex of the character pattern, for example. The endpoints are the starting point and the ending point of at least one line segment that corresponds to one stroke of the character (and is equivalent to a character line that will be described below).

The vertex may be, for example, an intersection point of two line segments that form a corner of the character. This sort of characteristic point is a candidate point for positioning the decorative pattern.

The characteristic point identification processing will be explained with reference to FIGS. 9 and 10. First, the CPU 11 initializes to zero the values of a block counter i, a stitch counter r, a line segment counter k, and a character line counter m (Step S10). The block counter i counts the number of blocks that are indicated by the block data. The stitch counter r counts the number of stitches in the single-stitch data. The line segment counter k counts the total of the number of line segments that correspond to center lines of the blocks that are indicated by the block data and the number of line segments that correspond to the stitches in the single-stitch data. The character line counter m counts the number of the character lines. The character line is the at least one line segment that corresponds to one stroke of the character, and the character line will be described in detail below. The counter values for each one of the counters i, r, k, and m are stored in the RAM 12.

Next, the CPU 11 defines, as target data, the first set of the shape data for creating the character pattern 51, which is the first of the character patterns 51 to 53 selected in the character selection processing at Step S1. The CPU 11 determines whether the target data are block data (Step S11). The CPU 11 may start the processing from one of the character patterns 52 and 53.

In a case where the target data are block data (YES at Step S11), the CPU 11 sets the value of a total number of blocks imax to the number of blocks that are continuous from the block that the target data (the block data) indicate (Step S12). For example, in a case where the number of continuous blocks is 3, including the block that the target data (the block data) indicate, the total number of blocks imax is set to 3. The CPU 11 initializes the block counter i to zero (Step S13). From the target i-th block data, the CPU 11 acquires the coordinates of the vertices p1 to p4 (refer to FIG. 12) of the block that the block data indicate (Step S14). In a case where the value of the block counter i is zero, the i-th block data are the first block data.

Figure 11:
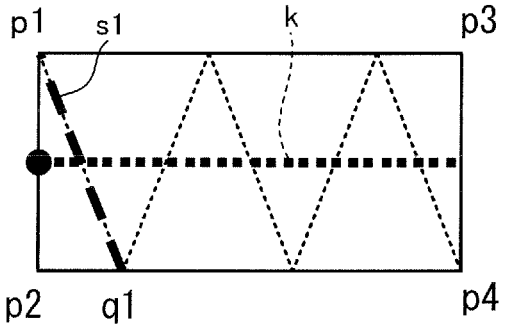
FIG. 11 is a figure that shows an example in which a point q1 is on a side p2-p4 in the block data.
Figure 12:
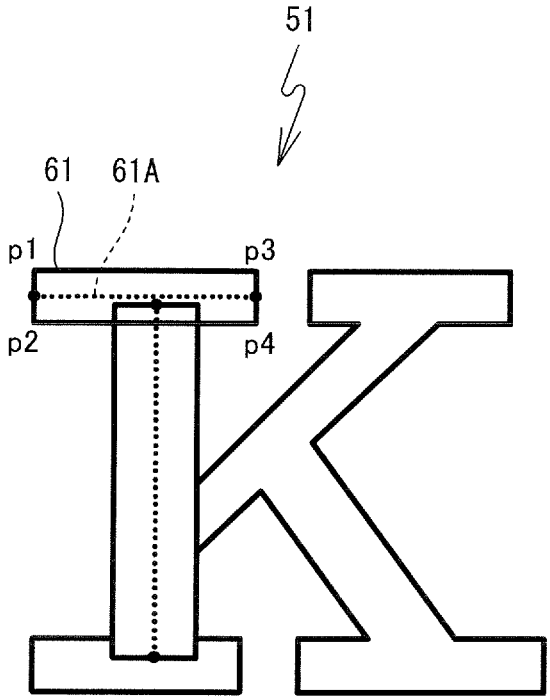
FIG. 12 is a figure that shows a line segment of the block data in the character pattern.

Next, in order to determine a direction of the block data, the CPU 11 acquires the coordinates for the point q1, which is the ending point of the first stitch s1 in the block data (Step S15). The direction of the block data means the direction in which the character is written. The first stitch s1 is a stitch for which the point p1, which is the start point, is defined as the starting point. The CPU 11 determines whether the point q1 is on the side p2-p4 (Step S16). In a case where the point q1 is on the side p2-p4 (YES at Step S16), as shown in FIG. 11, the direction of the block data is from the side p1-p2 toward the side p3-p4. Accordingly, the CPU 11 defines the center point of the side p1-p2 as the starting point of a k-th line segment (hereinafter called the line segment [k]) in the block data and defines the center point of the side p3-p4 as the ending point of the line segment [k] (Step S18). The line segment [k] is equivalent to a center line of the block data. In a case where the value of k is zero, the k-th line segment (the line segment [0]) is the first line segment. For example, in a first block 61 (i=0) of the character pattern 51, the positions of the starting point and the ending point of a line segment 61A (k=0) are defined, as shown in FIG. 12.

Figure 13:
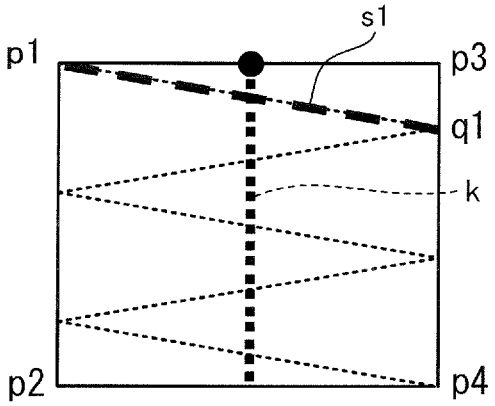
FIG. 13 is a figure that shows an example in which the point q1 is on a side p3-p4 in the block data.

In contrast, in a case where the point q1 is not on the side p2-p4 (NO at Step S16), the CPU 11 determines whether the point q1 is on the side p3-p4 (Step S17). In a case where the point q1 is on the side p3-p4 (YES at Step S17), as shown in FIG. 13, the direction of the block data is from the side p1-p3 toward the side p2-p4. Accordingly, the CPU 11 defines the center point of the side p1-p3 as the starting point of the line segment [k] and defines the center point of the side p2-p4 as the ending point of the line segment [k] (Step S19). The CPU 11 can thus determine the coordinates of the starting point and the ending point of the line segment [k] based on the block data and the coordinate data for the point q1, which is the ending point of the first stitch. For each line segment [k], the CPU 11 stores the coordinate data for the starting point and the ending point of the line segment [k] in the RAM 12. In a case where the point q1 is not on the side p3-p4 (NO at Step S17), the CPU 11 cannot define the starting point and the ending point of the line segment [k], so the CPU 11 forces the termination of the processing without doing anything.

In this manner, the positions of the starting point and the ending point of the line segment [k] are defined for the block data for one block. Therefore, the CPU 11 adds 1 to the block counter i and adds 1 to the line segment counter k (Step S20). Next, the CPU 11 determines whether the value of the block counter i has reached the value of the total number of blocks imax (Step S21). In a case where the value of the block counter i is less than the value of the total number of blocks imax (NO at Step S21), the CPU 11 returns to Step S14 and repeats the processing described above for the block data for the next block (Steps S14 to S20).

In a case where the value of the block counter i has reached the value of the total number of blocks imax (YES at Step S21), the calculation of the starting points and the ending points of the line segments [k] for the blocks that are continuous from the block that the target data (the block data) indicate has been completed. Accordingly, the CPU 11 determines whether all of the calculations of the starting points and the ending points of the line segments [k] have been completed for all of the shape data for creating the character pattern 51 (Step S27). In a case where the value of the line segment counter k matches the number of sets of the shape data for the character pattern, all of the calculations of the starting points and the ending points of the line segments [k] have been completed for the character pattern. The character pattern 51 is defined by the block data only. Therefore, in a case where the value of the block counter i has reached the value of the total number of blocks imax, the calculations of the starting points and the ending points of the line segments [k] have all been completed (YES at Step S27). In this case, as shown in FIG. 10, the CPU 11 advances the processing to Step S29, which will be described below.

Figure 14:
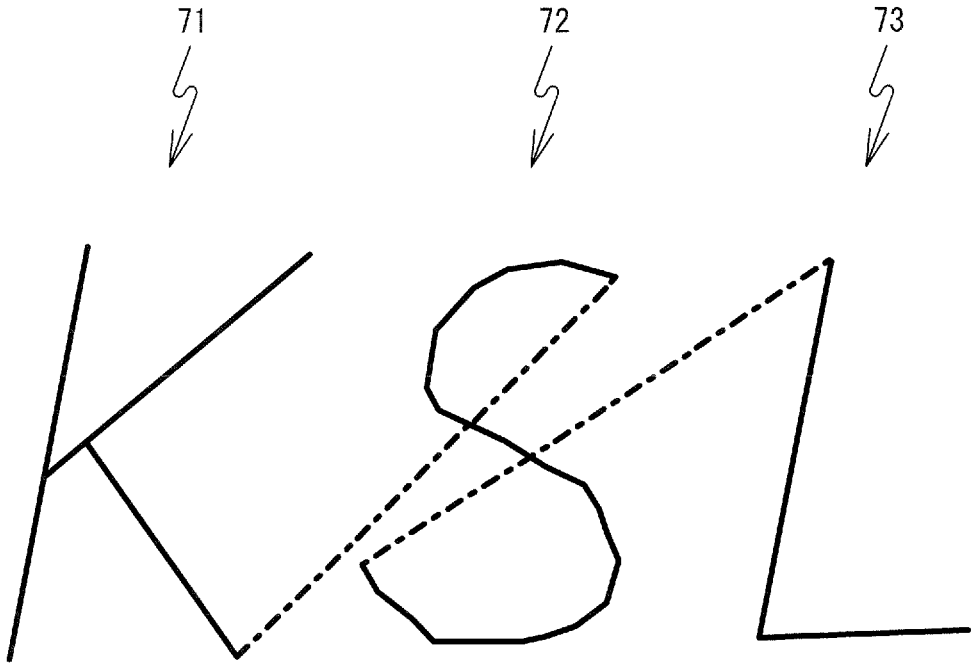
FIG. 14 is a figure that shows a character pattern that is configured from single-stitch data only.

The character pattern 51 shown in FIG. 12 is defined by the block data only. Depending on the style of the character pattern, the character pattern may be defined by the single-stitch data only or by a combination of the block data and the single-stitch data. The single-stitch data are coordinate data for the endpoints (the starting points and the ending points) of the stitches that form the shape of the character or the like. FIG. 14 shows character patterns 71 to 73, which are examples of a character style that is defined by the single-stitch data only. The character pattern 71 is the alphabetic character "K", the character pattern 72 is the alphabetic character "S", and the character pattern 73 is the alphabetic character "L". Where the character pattern is defined by the single-stitch data only, it is often the case that the shape of the character pattern is formed by the stitches themselves.

Figure 15:
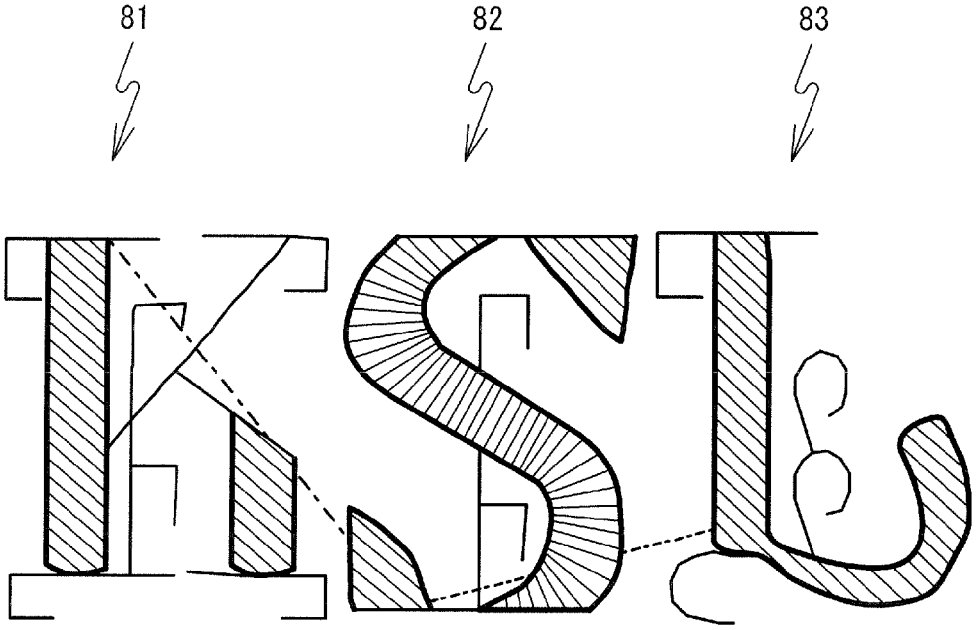
FIG. 15 is a figure that shows a character pattern that is configured by intermingling the block data and the single-stitch data.

In contrast, FIG. 15 shows character patterns 81 to 83, which are examples of a character style that is defined by a combination of the block data and the single-stitch data. The character pattern 81 is the alphabetic character "K", the character pattern 82 is the alphabetic character "S", and the character pattern 83 is the alphabetic character "L". A character style that is defined by a combination of the block data and the single-stitch data has a different visual quality from a character style that is defined by the block data only or the single-stitch data only, making a more creative impression. In a case where the character pattern is defined by the block data only, as described above, the CPU 11 calculates the starting point and the ending point of the line segment [k], which is the center line of the block. In a case where the shape data for the character pattern include the single-stitch data, then for the part of the character pattern that is defined by the single-stitch data, the CPU 11 may calculate starting points and ending points of line segments that correspond to stitches.

Returning to Step S9, in a case where the target data are single-stitch data, not block data (NO at Step S11), the CPU 11 sets the value of a total number of stitches rmax to the number of stitches that are continuous from the stitch that the target data (the single-stitch data) indicate (Step S22). For example, in a case where the number of continuous stitches is 3, including the stitch that the target data (the single-stitch data) indicate, the total number of stitches rmax is set to 3. The CPU 11 initializes the stitch counter r to zero (Step S23). Then the CPU 11 defines the starting point of the line segment [k] as the starting point of the target stitch [r] and defines the ending point of the line segment [k] as the ending point of the stitch [r] (Step S24). The CPU 11 stores the coordinate data for the starting point and the ending point of the line segment [k] in the RAM 12.

In this manner, the positions of the starting point and the ending point of the line segment [k] are defined for one stitch that the single-stitch data indicate. The CPU 11 adds 1 to the stitch counter r and the line segment counter k (Step S25). The CPU 11 determines whether the value of the stitch counter r has reached the value of the total number of stitches rmax (Step S26). In a case where the value of the stitch counter r is less than the value of the total number of stitches rmax (NO at Step S26), the CPU 11 returns to Step S24 and repeats the processing described above for the next set of the single-stitch data (Steps S24, S25).

In a case where the value of the stitch counter r has reached the value of the total number of stitches rmax (YES at Step S26), the calculation of the starting points and the ending points of the line segments [k] for the single-stitch data that indicate the stitches that are continuous from the stitch that the target data (the single-stitch data) indicate has been completed. Accordingly, the CPU 11 determines whether all of the calculations of the starting points and the ending points of the line segments [k] have been completed for all sets of the shape data for creating the character pattern (Step S27). For example in a case where the block data follow the single-stitch data for which the calculations have been completed, the calculations of the starting points and the ending points of the line segments [k] have not all been completed for the character pattern (NO at Step S27). Accordingly, the CPU 11 returns to Step S11 and, for the block data that indicate the next continuous block (YES at Step S11), repeats the processing that is described above (Steps S12 to S21). In a case where all of the calculations of the starting points and the ending points of the line segments [k] have been completed for the character pattern (YES at Step S27), the CPU 11 advances the processing to Step S29, as shown in FIG. 10.

Figure 10:
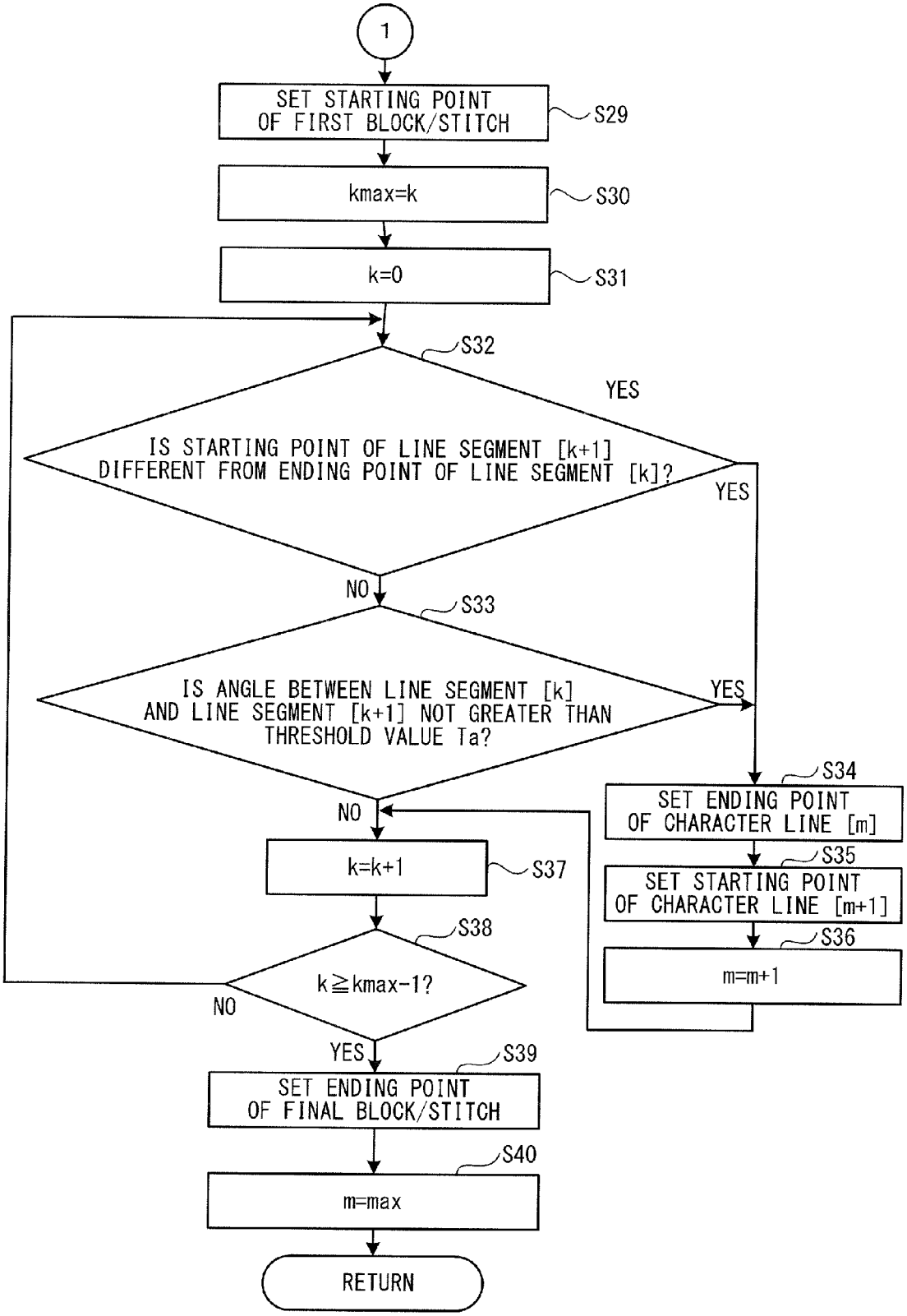
FIG. 10 is a flowchart of the characteristic point identification processing, continuing from FIG. 9.

As shown in FIG. 10, the CPU 11 defines the starting point of the first character line (m=0) as the starting point of the first block (or the first stitch) (Step S29). The character line is the at least one line segment that corresponds to one stroke of the character, and the character line is configured from the line segments [k]. The CPU 11 sets the value of a total number of line segments kmax to the current value of the line segment counter k (Step S30). The total number of line segments kmax is the total number of the line segments [k] in the character pattern 51. The CPU 11 once again initializes the line segment counter k to zero (Step S31).

Next, the CPU 11 determines whether the coordinates of the ending point of the line segment [k] are different from the coordinates of the starting point of the next line segment [k+1] (Step S32). In a case where the coordinates of the ending point of the line segment [k] are different from the coordinates of the starting point of the next line segment [k+1] (YES at Step S32), the ending point of the line segment [k] and the starting point of the next line segment [k+1] are in different positions. Accordingly, the CPU 11 defines the endpoint of the line segment [k] as the endpoint of the m-th character line (hereinafter called the character line [m]) (Step S34) and defines the starting point of the next line segment [k+1] as the starting point of the next character line [m+1] (Step S35). The CPU 11 stores the coordinates of the ending point of the character line [m] and the coordinates of the starting point of the character line [m+1] in the RAM 12. The CPU 11 adds 1 to the character line counter m (Step S36). In a case where the value of the character line counter m is zero, the m-th character line (the character line [0]) is the first character line.

Figure 16:
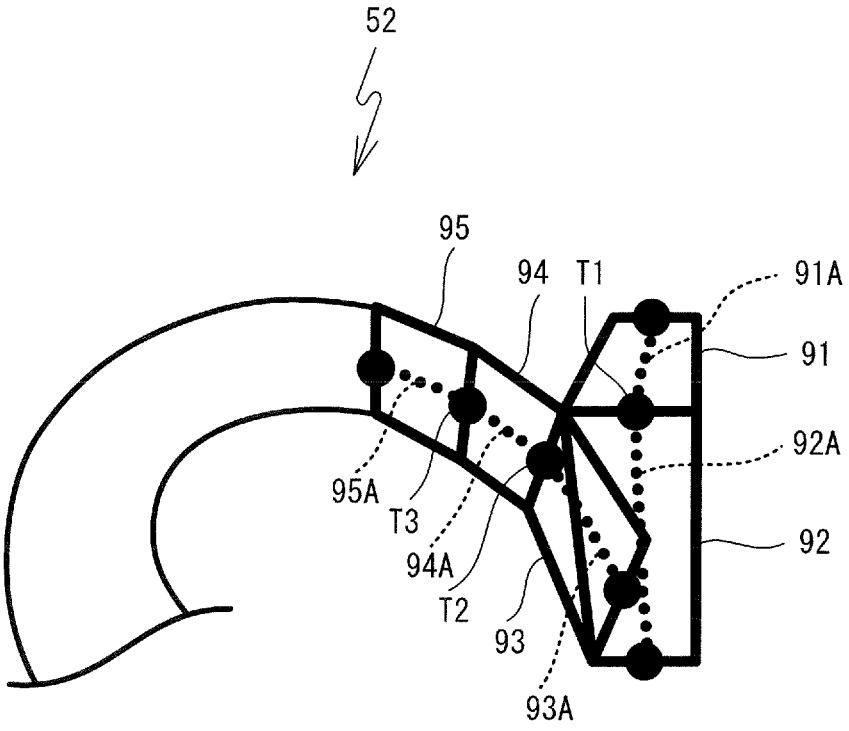
FIG. 16 is an explanatory figure of a method for determining an ending point of a character line in the character pattern.

Conversely, in a case where the coordinates of the ending point of the line segment [k] and the starting point of the next line segment [k+1] are the same (NO at Step S32), the positions of the ending point of the line segment [k] and the starting point of the next line segment [k+1] overlap. For example, as shown in FIG. 16, in blocks 91 to 95 at the beginning of the top of the "S" character pattern 52, the ending point of a line segment 91A of the block 91 and the starting point of a line segment 92A of the block 92 overlap at a point T1. The ending point of a line segment 93A of the block 93 and the starting point of a line segment 94A of the block 94 overlap at a point T2. The ending point of the line segment 94A of the block 94 and the starting point of a line segment 95A of the block 95 overlap at a point T3. In other words, two line segments are connected at each one of the point T1, the point T2, and the point T3. Therefore, the point T1, the point T2, and the point T3 are not endpoints of the character pattern.

In this sort of case, the CPU 11 determines whether the overlapping point is a vertex of the character pattern. The CPU 11 determines whether an angle that is formed by the line segment [k] and the next line segment [k+1] is less than or equal to a threshold value Ta (Step S33). The threshold value Ta may be 150 degrees, for example, but the threshold value Ta may be modified. In a case where the angle is greater than the threshold value Ta (NO at Step S33), the angle that is formed by the line segment [k] and the next line segment [k+1] is not small enough that the overlapping point can be regarded as a characteristic point. In this case, the overlapping point is not regarded as a vertex. Accordingly, the CPU 11 adds 1 to the line segment counter k (Step S37). In the example shown in FIG. 16, the angle at each one of the point T1, the point T2, and the point T3 is greater than the threshold value Ta. Therefore, none of the point T1, the point T2, and the point T3 is a vertex.

On the other hand, in a case where the angle is less than or equal to the threshold value Ta (YES at Step S33), the angle that is formed by the line segment [k] and the next line segment [k+1] is small enough that the overlapping point can be regarded as a characteristic point. The overlapping point is therefore regarded as a vertex. Accordingly, the CPU 11 defines the ending point of the line segment [k] as the ending point of the character line [m] (Step S34) and defines the starting point of the next line segment [k+1] as the starting point of the next character line [m+1] (Step S35). The CPU 11 stores the coordinates of the ending point of the character line [m] and the coordinates of the starting point of the character line [m+1] in the RAM 12. The CPU 11 adds 1 to the character line counter m (Step S36).

Figure 17:
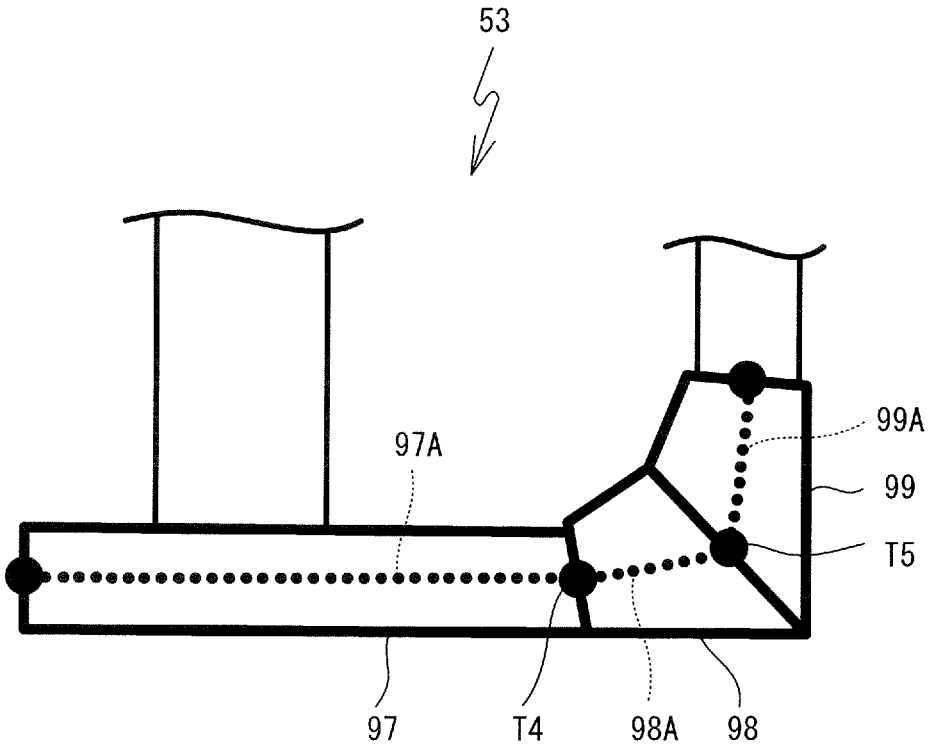
FIG. 17 is an explanatory figure of a method for determining a vertex point of a character line in the character pattern.
Figure 18:
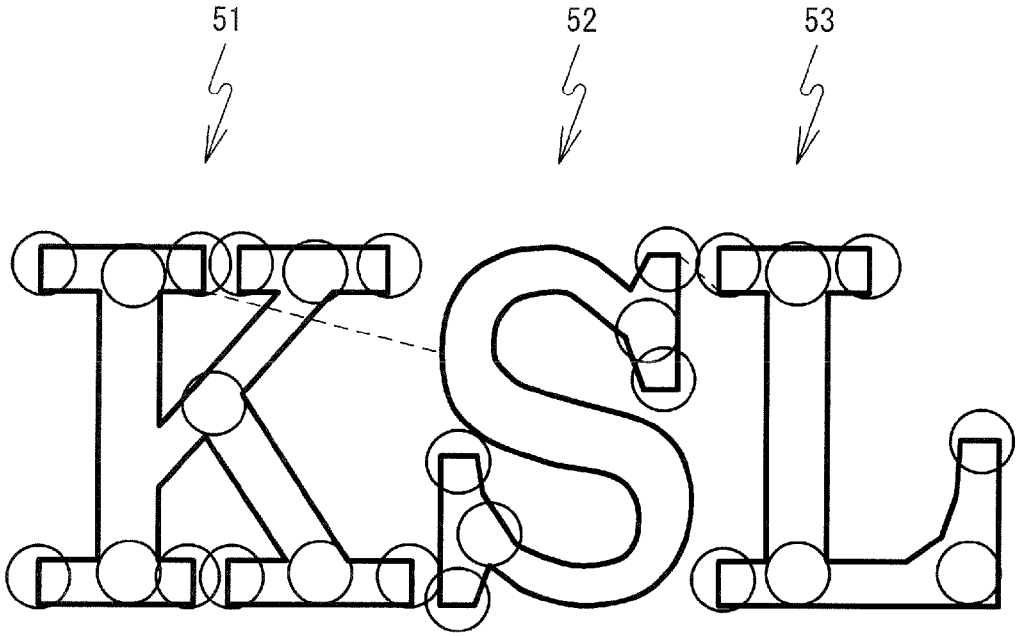
FIG. 18 is a figure that shows candidate points for positioning decorative patterns in the character pattern.

For example, as shown in FIG. 17, in blocks 97 to 99 at the end of the "L" character pattern 53, the ending point of a line segment 97A of the block 97 and the starting point of a line segment 98A of the block 98 overlap at a point T4. The ending point of the line segment 98A of the block 98 and the starting point of a line segment 99A of the block 99 overlap at a point T5. Therefore, the point T4 and the point T5 are not endpoints. At the point T4, the angle that is formed by the line segment 97A and the line segment 98A is greater than the threshold value Ta. Therefore, the point T4 is not a vertex. In contrast, at the point T5, the angle that is formed by the line segment 98A and the line segment 99A is not greater than the threshold value Ta. Therefore, the point T5 is a vertex.

Next, returning to FIG. 10, the CPU 11 determines whether the value of the line segment counter k has reached a value that is 1 less than the value of the total number of line segments kmax (Step S38). When the final line segment [k] is reached, there is no next line segment. Accordingly, there is no need to consider whether the ending point of the final line segment [k] is an endpoint. Therefore, at Step S38, the CPU 11 determines whether the value of the line segment counter k has reached the value that is 1 less than the value of the total number of line segments kmax. In a case where the value of the line segment counter k has not reached the value that is 1 less than the value of the total number of line segments kmax (NO at Step S38), the CPU 11 returns to Step S32. The CPU 11 proceeds to repeat the processing (Steps S32 to S37) for determining the endpoint of the next character line. In a case where the value of the line segment counter k has reached the value that is 1 less than the value of the total number of line segments kmax (YES at Step S38), the CPU 11 defines the ending point of the character line [m] as the ending point of the final block (or the final stitch, in the case of the single-stitch data) (Step S39). The CPU 11 stores the coordinates of the ending point of the character line [m] in the RAM 12. The CPU 11 sets the current value of the character line counter m to a total number of character lines mmax (Step S40). The total number of character lines mmax is the total number of the character lines in the character pattern 51. The CPU 11 processes the character patterns 52 and 53 in the same manner as the character pattern 51. The CPU 11 terminates the characteristic point identification processing and returns to the decorated character pattern creation processing shown in FIG. 4.

Figure 19:
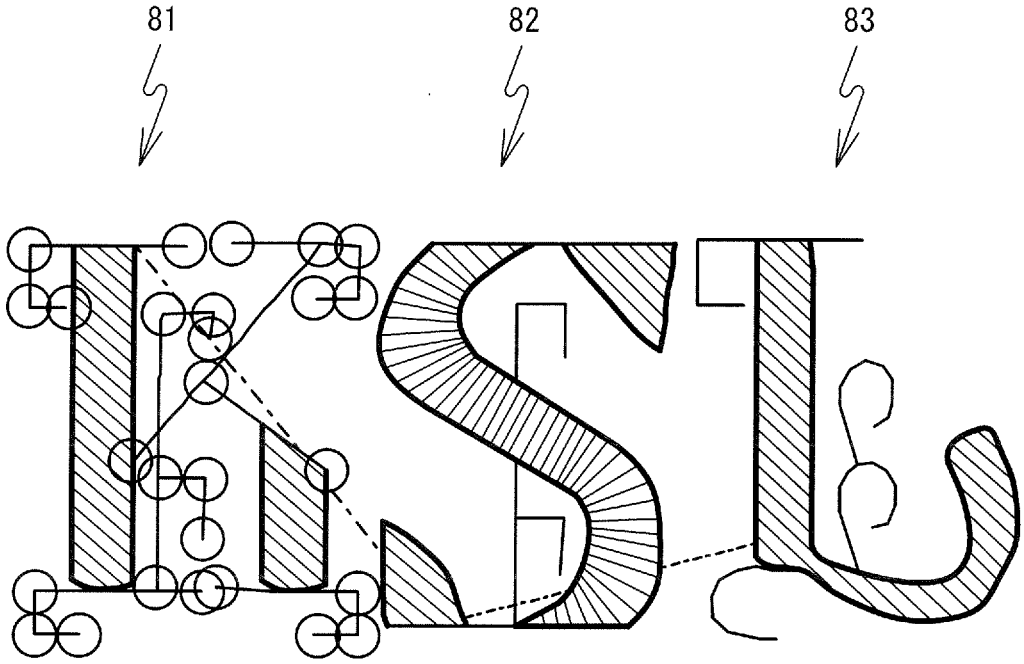
FIG. 19 is a figure that shows candidate points for positioning decorative patterns in parts of the character pattern that are configured from the single-stitch data.
Figure 20:
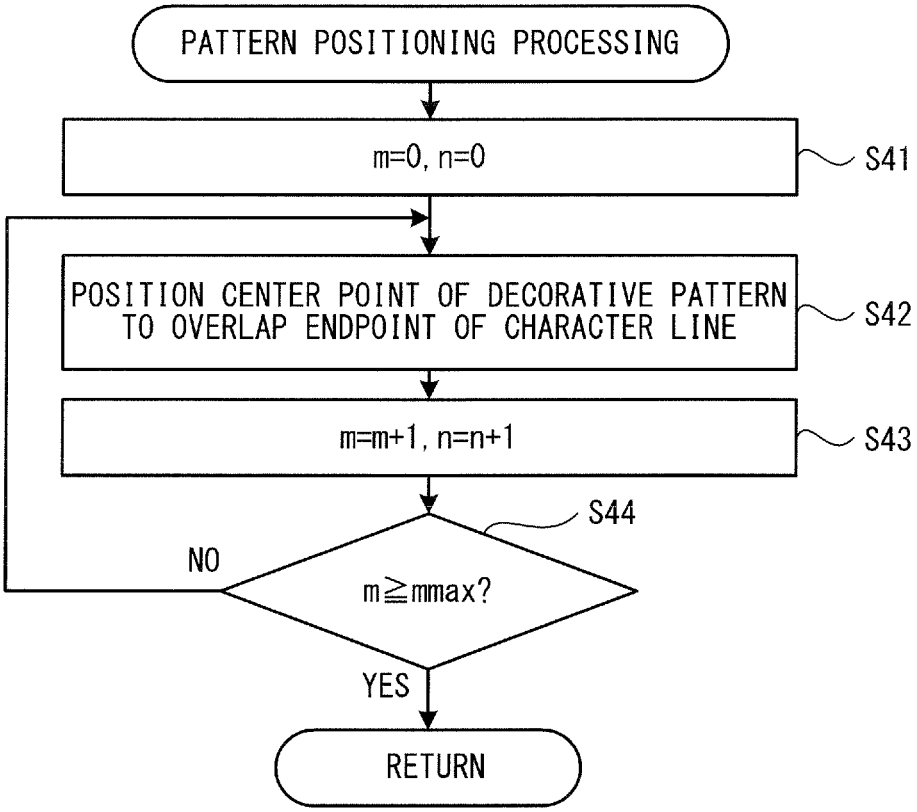
FIG. 20 is a flowchart of pattern positioning processing.

At the point when the characteristic point identification processing is terminated, the coordinate data for the starting point and the ending point of every character line [m] in each of the character patterns 51 to 53 are stored in the RAM 12. The starting point and the ending point of each character line [m] are the candidate points for positioning the decorative pattern 85. For example, the candidate points in the character patterns 51 to 53, which are defined by the block data only, are the center positions of the circles shown in FIG. 18. On the other hand, the candidate points in the character patterns 81 to 83, which are defined by a combination of the block data and the single-stitch data, are the center positions of the circles shown in FIG. 19. In FIG. 19, the candidate points for the character patterns 82 and 83 is omitted from the drawing. Next, the CPU 11 performs pattern positioning processing, which is shown in FIG. 20 (Step S6).

Figure 21:
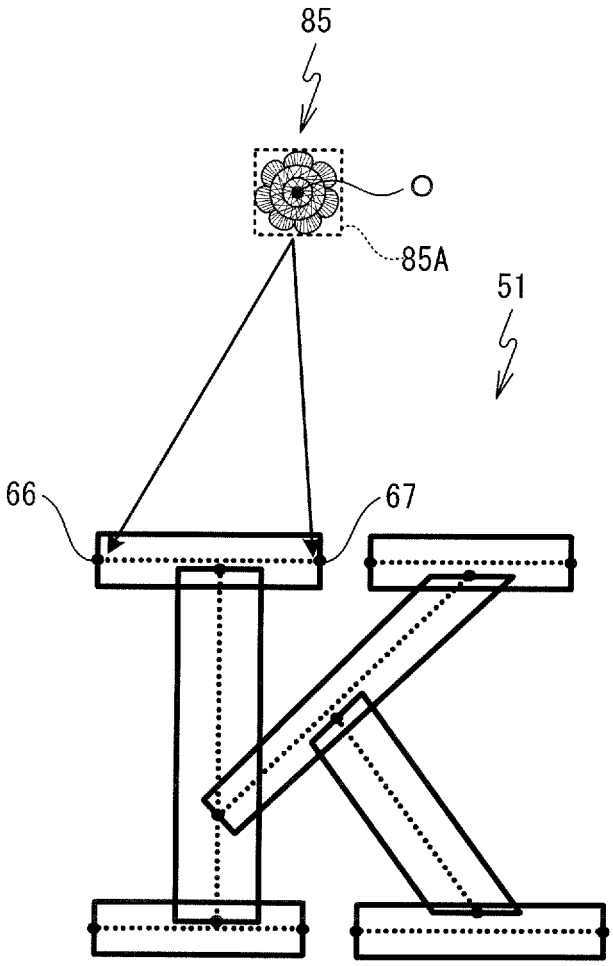
FIG. 21 is a figure that shows a form in which decorative patterns are positioned at a starting point and an ending point of a first character line (m=0)

The pattern positioning processing will be explained with reference to FIG. 20. The pattern positioning processing is processing that positions the decorative pattern at the candidate points identified by the characteristic point identification processing. First, the CPU 11 initializes the character line counter m and a positioned pattern counter n to zero (Step S41). The positioned pattern counter n counts the number of decorative patterns positioned on one character pattern. As shown in FIG. 21, the endpoints of each of the character lines [m] (refer to the broken lines in FIG. 21) in the character pattern 51 are candidate points for positioning the decorative pattern 85, for example. The CPU 11 positions the decorative pattern 85 such that the center point O of the decorative pattern 85 overlaps a starting point 66 and an ending point 67 of the first character line (m=0) (Step S42). The CPU 11 stores the coordinates of the mask data 85A of the positioned decorative patterns 85 in the RAM 12 as positioning data for the decorative patterns 85. The positioning of the decorative patterns 85 is thus completed for the one character line [m]. The CPU 11 adds 1 to the value of the character line counter m and adds 1 to the value of the positioned pattern counter n (Step S43).

Next, the CPU 11 determines whether the value of the character line counter m has reached the value of the total number of character lines mmax (Step S44). In a case where the value of the character line counter m is less than the value of the total number of character lines mmax (NO at Step S44), the CPU 11 returns to Step S41 and repeats the processing (Steps S42 to S43) until the positioning of the decorative patterns 85 has been completed for all of the character lines. In a case where the value of the character line counter m has reached the value of the total number of character lines mmax (YES at Step S44), the positioning of the decorative patterns 85 has been completed for all of the character lines. Therefore, the CPU 11 terminates the pattern positioning processing. The CPU 11 processes the character patterns 52 and 53 in the same manner as the character pattern 51.

Figure 22:
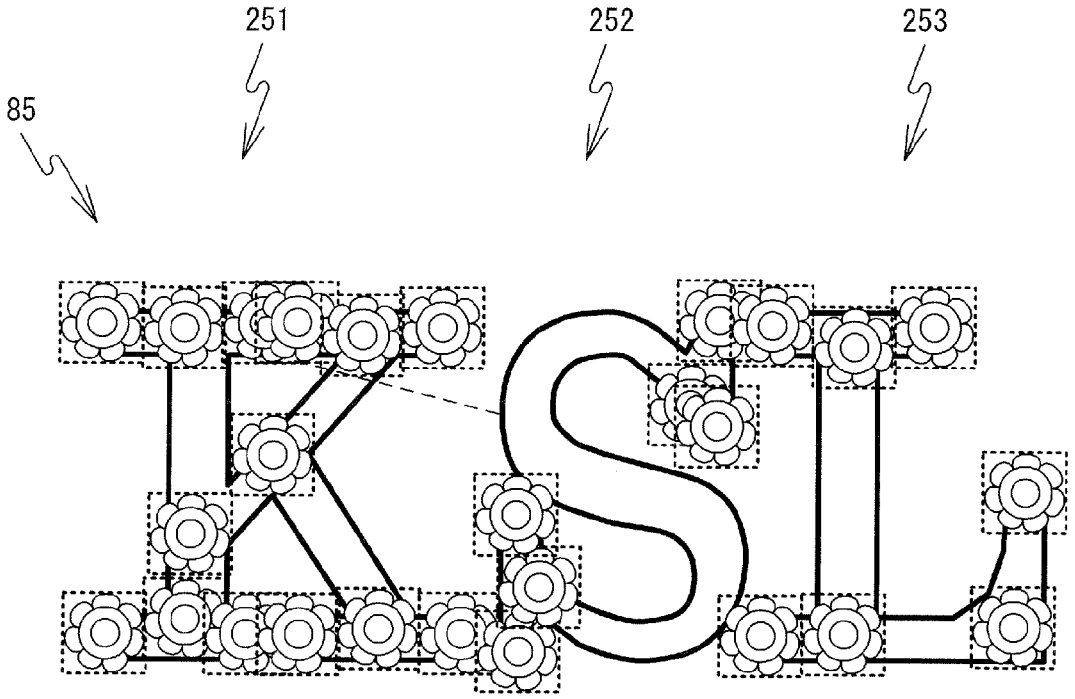
FIG. 22 is a figure that shows a decorated character pattern after the pattern positioning processing.

At the point when the pattern positioning processing is terminated, the character patterns 51 to 53 become decorated character patterns 251 to 253, which are shown in FIG. 22. At this stage, the decorative patterns 85 are positioned at all of the characteristic points of the decorated character patterns 251 to 253. Therefore, some of the decorative patterns 85 overlap one another. When the decorative patterns 85 overlap one another, the shapes of the decorative patterns 85 may be disfigured, depending on the extent of the overlapping. In such a case, the appearance of the decorated character patterns 251 to 253 therefore may be poorer. Accordingly, the CPU 11 returns to the processing shown in FIG. 4 and performs thinning-out processing (Step S7).

The thinning-out processing will be explained with reference to FIG. 23. First, the CPU 11 acquires a threshold value Tb from the ROM 13 (Step S50). The threshold value Tb is a threshold value for the ratio of a surface area S where two of the decorative patterns 85 overlap one another to a total surface area of the overlapping decorative patterns 85. For example, the threshold value Tb in the present embodiment is thirty percent. The threshold value Tb may be modified in accordance with the shape, the size, and the like of the decorative pattern. The threshold value Tb may be stored in a storage medium other than the ROM 13. For example, the threshold value Tb may be stored in the HDD 15.

In order to detect overlapping among all of the (fourteen) decorative patterns 85 positioned in the decorated character pattern 251 (refer to FIG. 22), the CPU 11 computes the amount of overlap between one target decorative pattern 85 and another of the decorative patterns 85, then compares the result to the threshold value Tb. In the present embodiment, the one target decorative pattern 85 is defined as a first pattern, and each one of the other decorative patterns 85 is defined as a second pattern. The CPU 11 initializes a first pattern counter v to zero (Step S51). The first pattern counter v counts the first patterns. Next, the CPU 11 initializes a second pattern counter w to zero (Step S52). The second pattern counter w counts the second patterns. The value of each of the counters v and w is stored in the RAM 12.

Figure 24:
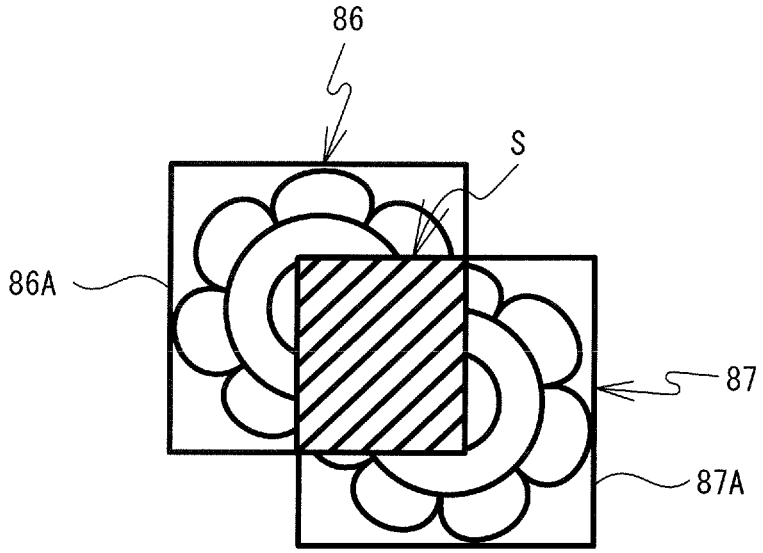
FIG. 24 is a figure that shows a surface area in which rectangular areas that are indicated by mask data for two decorative patterns partially overlap.

First, from among all of the (fourteen) decorative patterns 85 in the decorated character pattern 251, the CPU 11 selects, as the first pattern, the decorative pattern 85 positioned the earliest. Then, from among the other decorative patterns 85, the CPU 11 selects, as the second pattern, the decorative pattern 85 positioned the earliest. The CPU 11 computes the surface area S where the rectangular area that is indicated by the mask data for the first pattern overlaps the rectangular area that is indicated by the mask data for the second pattern (Step S53). For example, as shown in FIG. 24, a portion of the rectangular area that is indicated by mask data 86A for a decorative pattern 86, which is selected as the first pattern, overlaps a portion of the rectangular area that is indicated by mask data 87A for a decorative pattern 87, which is selected as the second pattern. Based on the coordinates of the mask data 86A and the mask data 87A, the CPU 11 computes the surface area S of the rectangular overlapping area (the rectangular area that is filled by diagonal lines in FIG. 24). In this manner, the CPU 11 detects that the decorative patterns 86 and 87 overlap. The larger the ratio of the surface area S to the total surface area of the overlapping decorative patterns 85, the greater the possibility becomes that the stitches of the decorative patterns 86 and 87 is disfigured during the sewing by the sewing machine 3. The possibility therefore exists that the shapes of the decorative patterns 86 and 87 is not identifiable.

Accordingly, the CPU 11 determines whether the ratio of the surface area S to the total surface area of the overlapping decorative patterns 85 is less than the threshold value Tb (Step S54). The threshold value Tb is the threshold value acquired at Step S50. In a case where the ratio of the surface area S to the total surface area of the overlapping decorative patterns 85 is less than the threshold value Tb (YES at Step S54), the first pattern and the second pattern are either separated from one another or the extent of the overlapping of the first pattern and the second pattern is small. Accordingly, the CPU 11 adds 1 to the second pattern counter w without deleting either one of the first pattern and the second pattern (Step S55). The determining of the extent of the overlapping in the combination of the first pattern and the second pattern has thus been completed.

Next, the CPU 11 determines whether the value of the second pattern counter w has reached the value of the positioned pattern counter n (Step S56). The initial value of positioned pattern counter n is the total number of the decorative patterns 85 that are positioned in the decorated character pattern 251. For example, the value of the positioned pattern counter n when the thinning-out processing starts is 14. In this case, the number of the decorative patterns 85 that are positioned in the decorated character pattern 251 is 14. In a case where the value of the second pattern counter w is less than the value of the positioned pattern counter n (NO at Step S56), the CPU 11 returns to Step S53. Then the CPU 11 then repeats the processing for a combination of the same first pattern as in the preceding round of the processing and a different second pattern from the second pattern in the preceding round of the processing.

In a case where the value of the second pattern counter w has reached the value of the positioned pattern counter n (YES at Step S56), the determining of the extent of the overlapping has been completed for all of the combinations of the first pattern and the plurality of the second patterns that are other than the first pattern. Accordingly, the CPU 11 adds 1 to the first pattern counter v (Step S57) and determines whether the value of the first pattern counter v is greater than or equal to value of the positioned pattern counter n (Step S58). In a case where the value of the first pattern counter v is less than the value of the positioned pattern counter n (NO at Step S58), the CPU 11 defines, as the first pattern, a decorative pattern 85 that is different from the first pattern in the preceding round of the processing. The CPU 11 returns to Step S52 and once again initializes the second pattern counter w to zero. Next, in the same manner as described above, the CPU 11 successively determines the extent of the overlapping between the new first pattern and the second patterns, which are the other decorative patterns 85.

In a case where the ratio of the surface area S where the first pattern and the second pattern overlap to the total surface area is not less than the threshold value Tb (NO at Step S54), the extent of the overlapping of the first pattern and the second pattern is large. Accordingly, in order to delete the first pattern, which is positioned earlier, the CPU 11 deletes the positioning data for the first pattern (Step S59). As described previously, the positioning data indicate the coordinates of the mask data 85A for the positioned decorative pattern 85. In this manner, one of the overlapping decorative patterns 85 on the character pattern is deleted. The CPU 11 then moves up by 1 the positioning order each of the remaining decorative patterns 85 that follow the deleted decorative pattern 85. The CPU 11 selects, as the first pattern, the decorative pattern 85 positioned the earliest among the decorative patterns 85 that have not yet been selected as the first pattern (Step S60). Furthermore, because one of the decorative patterns 85 has been deleted, the CPU 11 subtracts 1 from the value of the positioned pattern counter n (Step S61). The CPU 11 repeats the processing at Steps S52 to S61 for as long as the value of the first pattern counter v has not reached the value of the positioned pattern counter n (NO at Step S58).

In a case where the value of the first pattern counter v has reached the value of the positioned pattern counter n (YES at Step S58), the determining of the extent of the overlapping has been completed for all of the decorative patterns 85. Furthermore, in a case where two or more of the decorative patterns 85 overlap, the decorative patterns 85 have been thinned out appropriately. The CPU 11 also performs the processing that is described above for the decorated character patterns 252 and 253, in the same manner as for the decorated character pattern 251. The CPU 11 then terminates the thinning-out processing.

Figure 25:
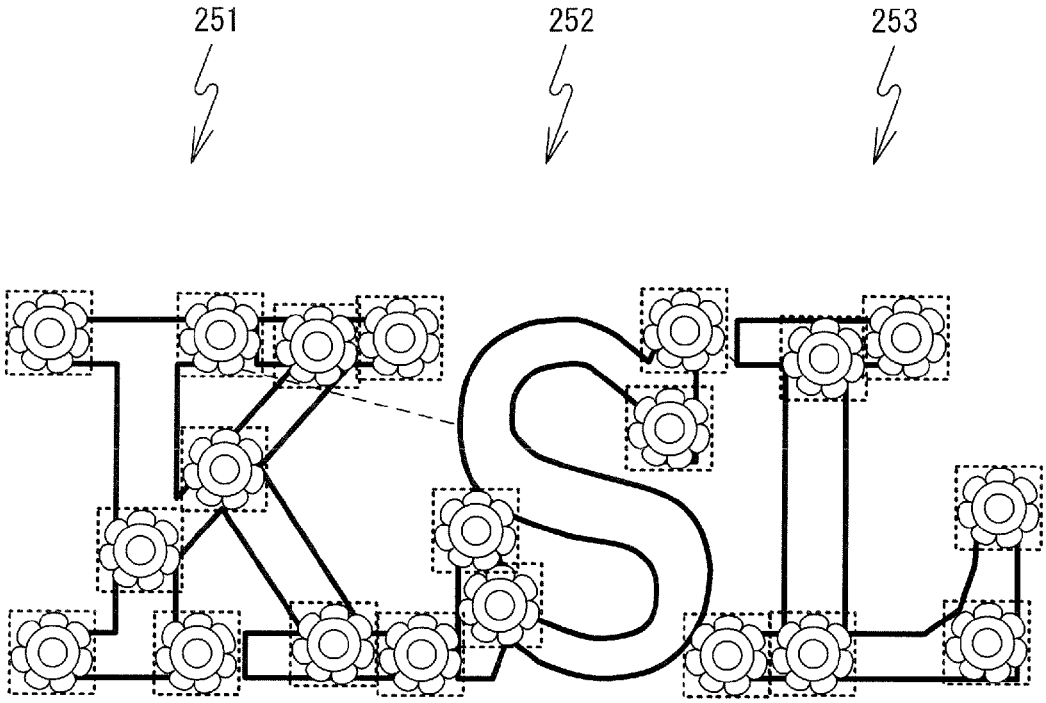
FIG. 25 is a figure that shows the decorated character pattern after the thinning-out processing.

As shown in FIG. 25, at the point when the thinning-out processing is completed, the decorative patterns 85 on the decorated character patterns 251 to 253 have been thinned out appropriately. Compared to the decorated character patterns 251 to 253 prior to the performing of the thinning-out processing (refer to FIG. 22), the decorative patterns 85 have been thinned out appropriately. Accordingly, the characters in the decorated character patterns 251 to 253 may be more easily visible, and their overall appearance may be improved.

Next, the CPU 11 returns to the decorated character pattern creation processing shown in FIG. 4 and displays the tinned-out decorated character patterns 251 to 253 on the display 21 (Step S8). The user is able to check the decorated character patterns 251 to 253 on the display 21.

The CPU 11 then generates the sewing data for sewing the decorated character patterns 251 to 253 (Step S9). The sewing data include the character pattern data for each one of the character patterns 51 to 53, the decorative pattern data for the decorative patterns 85, the positioning data for the decorative patterns 85, sewing order data, and the like. The character pattern data are acquired from the character pattern data storage area 152 of the HDD 15. The decorative pattern data are acquired from the decorative pattern data storage area 153 of the HDD 15. The positioning data are acquired from the RAM 12. The sewing order data are data for a sewing order in which the decorative patterns are sewn after the character pattern is sewn. The CPU 11 may store the generated sewing data in the sewing data storage area 154 of the HDD 15. The CPU 11 may store the generated sewing data in the storage medium 55 through the connector 19. The CPU 11 terminates the decorated character pattern creation processing.

As explained above, the sewing data generation device 1 of the present embodiment is able to generate the sewing data for the decorated character pattern. The decorated character pattern is a character pattern in which a decorative pattern is combined with a character pattern. The CPU 11 of the sewing data generation device 1 acquires the shape data that are included in the character pattern data for the character pattern 51, for example, which is the alphabetic character "K". Based on the shape data, the CPU 11 identifies the characteristic points of the character pattern 51. The characteristic points are the endpoints and the vertices of the character pattern 51, for example. The CPU 11 positions the floral decorative patterns 85, for example, at the characteristic points identified in the character pattern 51. The CPU 11 defines the coordinates of the characteristic points where the decorative patterns 85 are positioned as the coordinates of the center points of the decorative patterns 85 that are indicated by the mask data. The CPU 11 stores the mask data coordinates in the RAM 12 as the positioning data. The CPU 11 generates the sewing data for the decorated character pattern 251 based on the character pattern data for the character pattern 51, the decorative pattern data for the decorative patterns 85, and the positioning data for the decorative patterns 85. The sewing data include the sewing order data for the sewing order in which the decorative patterns 85 are sewn after the character pattern 51 is sewn.

In this manner, the sewing data generation device 1 is able to identify the characteristic points of the character pattern 51 and automatically position the decorative patterns 85 at the characteristic points. Therefore, the sewing data for sewing the decorated character pattern 251 can be generated easily. Even in a case where the user has selected a different character pattern or decorative pattern, for example, the decorative patterns are automatically positioned in relation to the character pattern. Therefore, it is not necessary for the user to reposition the decorative patterns manually. Furthermore, even in a case where the style of the character pattern is changed, the characteristic points of the character pattern that correspond to the new style are newly identified. The decorative patterns are positioned at the newly identified characteristic points. Therefore, it is not necessary for the user to reposition the decorative patterns manually.

Figure 9:
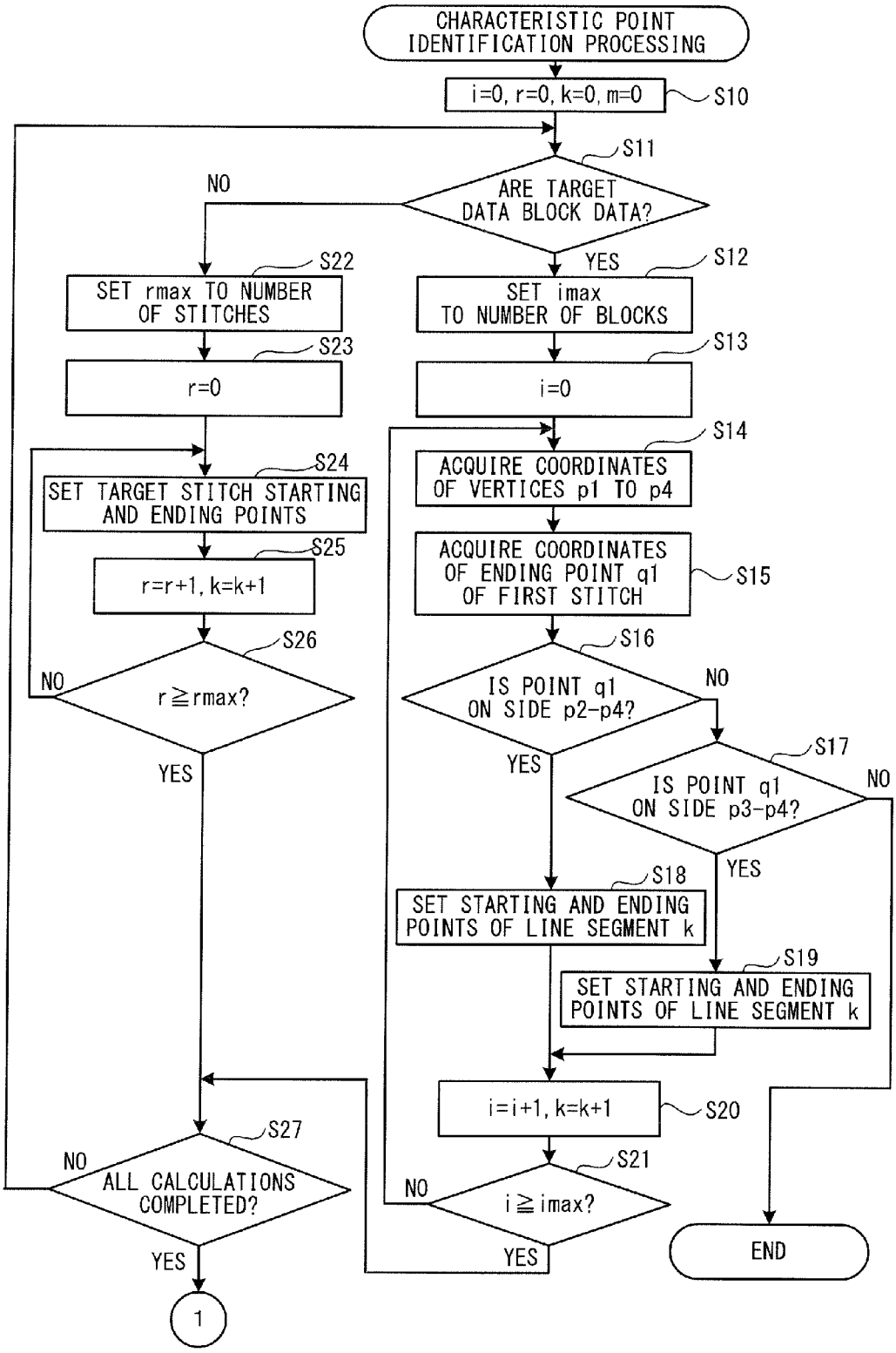
FIG. 9 is a flowchart of characteristic point identification processing.

In the present embodiment, in the characteristic point identification processing shown in FIGS. 9 and 10, the CPU 11 identifies the characteristic points of the character pattern by referring to at least one of the block data and the single-stitch data. The block data and the single-stitch data are the shape data that are included in the character pattern data. By referring to at least one of the block data and the single-stitch data, the CPU 11 is able to identify specifically a pattern shape of the character pattern. The CPU 11 is therefore able to identify the endpoints and the vertex accurately.

In the present embodiment, in the pattern positioning processing shown in FIG. 20, the CPU 11 stores in the RAM 12, as the positioning data, the coordinates of the mask data for the decorative patterns that are positioned on the character pattern. Furthermore, in the thinning-out processing shown in FIG. 23, the CPU 11 detects the overlapping of two or more of the decorative patterns, based on the positioning data for each one of the decorative patterns that are positioned on the character pattern. In a case where the overlapping of two or more of the decorative patterns is detected, the CPU 11 identifies the decorative pattern to be deleted from among of the overlapping decorative patterns, based on a specified condition. The CPU 11 deletes the positioning data for the identified decorative pattern. The decorative patterns may thus be more easily visible, and the overall appearance of the decorated character pattern may be improved.

Figure 23:
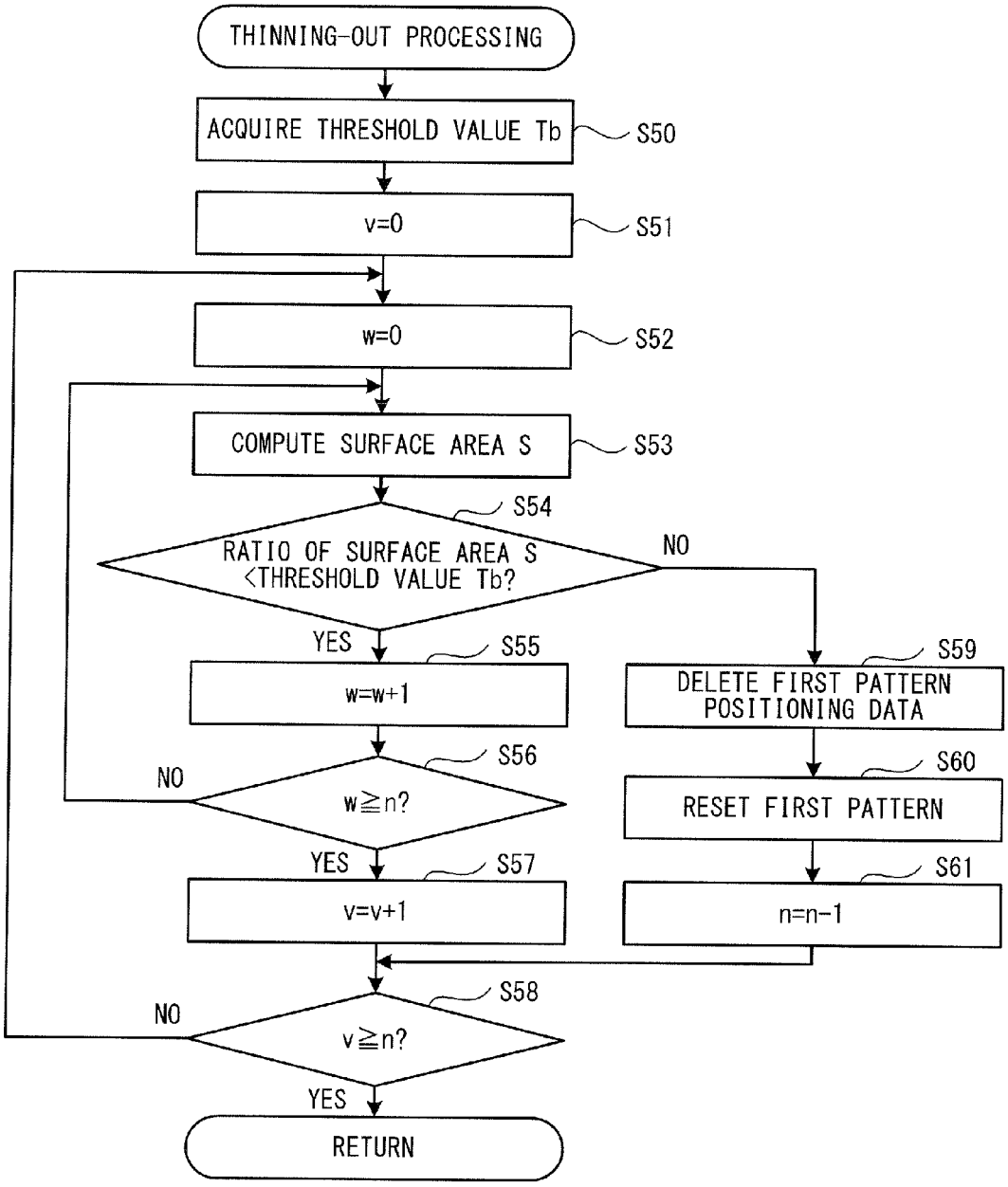
FIG. 23 is a flowchart of thinning-out processing.

In the present embodiment, in the thinning-out processing shown in FIG. 23, the specified condition for deleting a decorative pattern is that, in a case where the ratio of the surface area S where two decorative patterns overlap to the total surface area of the overlapping decorative patterns is not less than the threshold value Tb, one of the overlapping decorative patterns is to be deleted. Thus, in a case where two or more decorative patterns overlap, the CPU 11 is able to thin out the decorative patterns appropriately according to the specified condition. It is therefore possible to improve the balance of the positioning of the decorative patterns in the decorated character pattern.

Various types of modifications can be made to the embodiment that is described above. In the embodiment that is described above, a general-purpose device such as a personal computer or the like is used as the sewing data generation device 1. However, the sewing data generation device 1 may also be a device that is dedicated to generating the embroidery data. The sewing data generation device 1 may also be incorporated into a sewing machine.

In the embodiment that is described above, a mode is explained in which the decorative patterns are positioned on the character pattern. Instead of the character pattern, a different embroidery pattern, such as a pictorial figure, a symbol, or the like, for example, may be used. Instead of a design (a floral design) such as the decorative pattern 85 in the embodiment that is described above, a different embroidery pattern, such as a text character, a pictorial figure, a symbol, or the like, for example, may be used. Such an embroidery pattern may be selected from among various types of embroidery patterns.

In the decorated character pattern creation processing shown in FIG. 4 in the embodiment that is described above, the thinning-out processing (Step S7) may be omitted. The sewing data generation device 1 may be configured such that the user can select whether or not to perform the thinning-out processing.

In the pattern positioning processing shown in FIG. 20 in the embodiment that is described above, the decorative patterns 85 are positioned at all of the candidate points for the decorative patterns 85 that are identified by the characteristic point identification processing shown in FIGS. 9 and 10. However, the decorative patterns 85 may be positioned at fixed intervals (such as at every other candidate point, for example). In the embodiment that is described above, the decorative patterns 85 that are positioned on the character pattern are all the same size. However, the sizes of the decorative patterns 85 may be enlarged and reduced according to the locations where the decorative patterns 85 are positioned, for example.

In the embodiment that is described above, the endpoints and the vertex of the character pattern are both identified as the characteristic points. Then the decorative patterns are positioned at the identified characteristic points. However, it is acceptable for only the endpoints or only the vertex of the character pattern to be identified, in accordance with a selection operation by the user, for example. Then the decorative pattern may be positioned at the identified characteristic point. The sewing data generation device 1 may be configured such that the user can use the input portion 20 to delete a decorated pattern manually while checking the decorated character patterns that are displayed on the display 21.

In the embodiment that is described above, in the characteristic point identification processing shown in FIGS. 9 and 10, the starting points and the ending points of the line segments that correspond to the center lines of the individual blocks in the block data are determined. However, it is not always necessary for the center lines of the individual blocks in the block data to be identified. It is sufficient for a line segment that indicates the direction of the block data to be identified.

In the embodiment that is described above, in the thinning-out processing shown in FIG. 23, in a case where the ratio of the surface area S where the first pattern and the second pattern overlap to the total surface area of the overlapping decorative patterns is not less than the threshold value Tb (NO at Step S54), the positioning data for the decorative pattern 85 positioned earlier are deleted. The decorative pattern 85 that was positioned later is given priority and left in place (refer to Step S59). However, it is acceptable to give priority to and leave in place either one of the decorative pattern 85 positioned earlier and the decorative pattern 85 positioned later.

In the embodiment that is described above, at Step S59 of the thinning-out processing shown in FIG. 23, the positioning data for the first pattern are deleted in order to delete the positioned decorative pattern 85. However, processing that invalidates the positioning data, for example, may be performed.

The decorated character pattern creation processing in the embodiment that is described above is not limited to the example of being performed by the CPU 11. The decorated character pattern creation processing may be performed by a different electronic part (for example, an ASIC). The decorated character pattern creation processing may be performed by distributed processing by a plurality of electronic parts (that is, a plurality of CPUs). For example, a portion of the decorated character pattern creation processing may be performed by a server (not shown in the drawings) that is connected to the sewing data generation device 1.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a processor; and a memory configured to store computer-readable instructions, wherein the computer-readable instructions, when executed by the processor, cause the apparatus to perform processes of:

acquiring first pattern data and second pattern data, the first pattern data being data for sewing a first embroidery pattern, and the second pattern data being data for sewing each of at least one second embroidery pattern;

identifying, based on the first pattern data, at least one characteristic point of a pattern shape describing the first embroidery pattern, the at least one characteristic point being at least one point on the first embroidery pattern;

setting positioning data for positioning the at least one second embroidery pattern at the respective identified at least one characteristic point, the at least one second embroidery pattern being positioned on the respective at least one characteristic point, and the at least one second embroidery pattern being overlapped with the first embroidery pattern; and generating sewing data, after the positioning data is set, based on the first pattern data, the second pattern data, and the positioning data, the sewing data being data for sewing the first embroidery pattern and the at least one second embroidery pattern in a sewing order in which the at least one of second embroidery pattern is sewn after the first embroidery pattern is sewn.

2. The apparatus according to claim 1, wherein the first pattern data include at least one of at least one set of block data and a plurality of sets of needle drop point coordinate data, each of the at least one set of block data being data that indicate a four-sided block for creating a shape of the first embroidery pattern, and the plurality of sets of needle drop point coordinate data being data that indicate coordinates of needle drop points for sewing the first embroidery pattern, each of the at least one characteristic point is one of an endpoint and a vertex of the pattern shape describing the first embroidery pattern, and the identifying of the at least one characteristic point includes identifying the at least one characteristic point based on at least one of the at least one set of the block data and the plurality of sets of the needle drop point coordinate data.

3. The apparatus according to claim 2, wherein the computer-readable instructions, when executed by the processor, further cause the apparatus to perform processes of:

detecting, based on the positioning data, overlapping of at least two of a plurality of second embroidery patterns positioned at a respective plurality of characteristic points of the first embroidery pattern, the at least one embroidery pattern including the plurality of second embroidery patterns, and the at least one characteristic point including the plurality of characteristic points;

determining a second embroidery pattern to be deleted, from among the overlapping at least two second embroidery patterns, based on a specified condition; and revising the positioning data by deleting positioning data for the determined second embroidery pattern to be deleted.

4. The apparatus according to claim 3, wherein the specified condition is an overlapping ratio of two overlapping second embroidery patterns, and one of the two overlapping second embroidery patterns is deleted when the overlapping ration is equal to or greater than a predetermined value, the overlapping ratio being a ratio of a surface area of an overlapping portion of the two overlapping second embroidery patterns to a total surface area of the two overlapping second embroidery patterns.

5. The apparatus according to claim 1, wherein the computer-readable instructions, when executed by the processor, further cause the apparatus to perform processes of:

detecting, based on the positioning data, overlapping of at least two of a plurality of second embroidery patterns positioned at a respective plurality of characteristic points of the first embroidery pattern, the at least one embroidery pattern including the plurality of second embroidery patterns, and the at least one characteristic point including the plurality of characteristic points;

determining a second embroidery pattern to be deleted, from among the overlapping at least two second embroidery patterns, based on a specified condition; and revising the positioning data by deleting positioning data for the determined second embroidery pattern to be deleted.

6. The apparatus according to claim 5, wherein the specified condition is an overlapping ratio of two overlapping second embroidery patterns, and one of the two overlapping second embroidery patterns is deleted when the overlapping ratio is equal to or greater than a predetermined value, the overlapping ratio being a ratio of a surface area of an overlapping portion of the two overlapping second embroidery patterns to a total surface area of the two overlapping second embroidery patterns.

7. A non-transitory computer-readable medium storing computer-readable instructions that, when executed by a processor of an apparatus, cause the apparatus to perform processes comprising:

acquiring first pattern data and second pattern data, the first pattern data being data for sewing a first embroidery pattern, and the second pattern data being data for sewing each of at least one second embroidery pattern;

identifying, based on the first pattern data, at least one characteristic point of a pattern shape describing the first embroidery pattern, the at least one characteristic point being at least one point on the first embroidery pattern;

setting positioning data for positioning the at least one second embroidery pattern at the respective identified at least one characteristic point, the at least one second embroidery pattern being positioned on the respective at least one characteristic point, and the at least one second embroidery pattern being overlapped with the first embroidery pattern; and generating sewing data, after the positioning data is set, based on the first pattern data, the second pattern data, and the positioning data, the sewing data being data for sewing the first embroidery pattern and the at least one second embroidery pattern in a sewing order in which the at least one of second embroidery pattern is sewn after the first embroidery pattern is sewn.

8. The non-transitory computer-readable medium according to claim 7, wherein the first pattern data include at least one of at least one set of block data and a plurality of sets of needle drop point coordinate data, each of the at least one set of block data being data that indicate a four-sided block for creating a shape of the first embroidery pattern, and the plurality of sets of needle drop point coordinate data being data that indicate coordinates of needle drop points for sewing the first embroidery pattern, each of the at least one characteristic point is one of an endpoint and a vertex of the pattern shape describing the first embroidery pattern, and the identifying of the at least one characteristic point includes identifying the at least one characteristic point based on at least one of the at least one set of the block data and the plurality of sets of the needle drop point coordinate data.

9. The non-transitory computer-readable medium according to claim 8, wherein the computer readable instructions, when executed by the processor, further cause the apparatus to perform processes comprising:

detecting, based on the positioning data, overlapping of at least two of a plurality of second embroidery patterns positioned at a respective plurality of characteristic points of the first embroidery pattern, the at least one embroidery pattern including the plurality of second embroidery patterns, and the at least one characteristic point including the plurality of characteristic points;

determining a second embroidery pattern to be deleted, from among the overlapping at least two second embroidery patterns, based on a specified condition; and revising the positioning data by deleting positioning data for the determined second embroidery pattern to be deleted.

10. The non-transitory computer-readable medium according to claim 9, wherein the specified condition is an overlapping ratio of two overlapping second embroidery patterns, and one of the two overlapping second embroidery patterns is deleted when the overlapping ratio is equal to or greater than a predetermined value, the overlapping ratio being a ratio of a surface area of an overlapping portion of the two overlapping second embroidery patterns to a total surface area of the two overlapping second embroidery patterns.

11. The non-transitory computer-readable medium according to claim 7, wherein the computer readable instructions, when executed by the processor, further cause the apparatus to perform processes comprising:

detecting, based on the positioning data, overlapping of at least two of a plurality of second embroidery patterns positioned at a respective plurality of characteristic points of the first embroidery pattern, the at least one embroidery pattern including the plurality of second embroidery patterns, and the at least one characteristic point including the plurality of characteristic points;

determining, a second embroidery pattern to be deleted, from among the overlapping at least two second embroidery patterns, based on a specified condition; and revising the positioning data by deleting positioning data for the determined second embroidery pattern to be deleted.

12. The non-transitory computer-readable medium according to claim 11, wherein the specified condition is an overlapping ratio of two overlapping second embroidery patterns, and one of the two overlapping second embroidery patterns is deleted when the overlapping ratio is equal to or greater than a predetermined value, the overlapping ratio being a ratio of a surface area of an overlapping portion of the two overlapping second embroidery patterns to a total surface area of the two overlapping second embroidery patterns.

* * * * *